US005244510A

United States Patent [19]

Bogatin

[11] Patent Number: 5,244,510

[45] Date of Patent: Sep. 14, 1993

[54] MAGNETIC MATERIALS AND PROCESS FOR PRODUCING THE SAME

[76] Inventor: Yakov Bogatin, 2 Covered Bridge Path, Philadelphia, Pa. 19115

[21] Appl. No.: 732,513

[22] Filed: Jul. 18, 1991

Related U.S. Application Data

[60] Division of Ser. No. 535,460, Jun. 8, 1990, Pat. No. 5,122,203, which is a continuation-in-part of Ser. No. 365,622, Jun. 13, 1989, Pat. No. 5,114,502.

[51] Int. Cl.[5] ..... H01F 1/02

[52] U.S. Cl. ..... 148/104; 148/105; 427/127; 427/215; 427/255.4; 427/399; 428/403; 428/547; 419/12; 419/13; 419/14; 419/29; 419/30; 419/34; 419/35; 419/38; 419/44; 419/55

[58] Field of Search ..... 148/101, 104, 105; 427/127, 215, 255.4, 399; 428/403, 547; 241/18, 24; 419/12, 13, 14, 29, 30, 34, 35, 38, 44, 55

[56] References Cited

U.S. PATENT DOCUMENTS

| | | | |
|---|---|---|---|
| 4,043,845 | 8/1977 | Dionne | 148/105 |
| 4,192,696 | 3/1980 | Menth | 148/101 |
| 4,322,257 | 3/1982 | Menth et al. | 148/101 |
| 4,585,473 | 3/1986 | Narasimhan | 75/0.5 C |
| 4,588,439 | 5/1986 | Narasimhan et al. | 148/302 |
| 4,597,938 | 7/1986 | Matsuura et al. | 419/23 |
| 4,601,875 | 7/1986 | Yamamoto et al. | 419/23 |
| 4,684,406 | 8/1987 | Matsuura et al. | 75/244 |
| 4,747,874 | 5/1988 | Ghandehari | 75/255 |
| 4,762,574 | 8/1988 | Ghandehari | 148/103 |
| 4,767,450 | 8/1988 | Ishigaki et al. | 148/302 |
| 4,767,474 | 8/1988 | Fujimura | 148/302 |
| 4,769,063 | 9/1988 | Ishigaki | 75/0.5 BA |
| 4,770,702 | 9/1988 | Ishigaki et al. | 75/244 |
| 4,770,723 | 9/1988 | Sagawa et al. | 148/302 |
| 4,773,950 | 9/1988 | Fujimura et al. | 148/302 |
| 4,792,368 | 12/1988 | Sagawa et al. | 148/302 |

(List continued on next page.)

FOREIGN PATENT DOCUMENTS

| | | |
|---|---|---|
| 0177371 | 4/1986 | European Pat. Off. . |
| 55-11339 | 1/1980 | Japan . |
| 60-131949 | 7/1985 | Japan . |
| 60-144907 | 7/1985 | Japan . |
| 60-159152 | 8/1985 | Japan . |
| 62-112702 | 5/1987 | Japan . |
| 62-257705 | 11/1987 | Japan . |
| 62-294159 | 12/1987 | Japan . |
| 63-297504 | 12/1988 | Japan . |
| 64-69001 | 3/1989 | Japan . |

OTHER PUBLICATIONS

Coey et al, "Improved Magnetic Properties by Treatment of Iron-Based Rare Earth Intermetallic Compounds in Ammonia", 1990.

(List continued on next page.)

*Primary Examiner*—John P. Sheehan

[57] ABSTRACT

This invention relates to a process for producing a rare earth-containing powder comprising crushing a rare earth-containing alloy in a passivating gas at a temperature from ambient temperature to a temperature below the phase transformation temperature of the material.

Additionally, this invention relates to a process for producing a rare earth-containing powder compact comprising crushing a rare earth-containing alloy in water, compacting the crushed alloy material, drying the compacted alloy material at a temperature below the phase transformation temperature of the material, and treating the compacted alloy material with a passivating gas at a temperature from ambient temperature to a temperature below the phase transformation temperature of the material.

Rare earth-containing alloys suitable for use in producing magnets utilizing the powder metallurgy technique, such as Nd-Fe-B and Sm-Co alloys, can be used. The passivating gas can be nitrogen, carbon dioxide or a combination of nitrogen and carbon dioxide.

The present invention further relates to the production of a permanent magnet comprising the above steps, and then sintering the compacted material at a temperature of from about 900° C. to about 1200° C., and heat treating the sintered material at a temperature of from about 200° C. to about 1050° C.

46 Claims, 30 Drawing Sheets

U.S. PATENT DOCUMENTS

| | | | |
|---|---|---|---|
| 4,801,340 | 1/1989 | Inoue et al. | 148/103 |
| 4,802,931 | 2/1989 | Croat | 148/302 |
| 4,806,155 | 2/1989 | Camp et al. | 75/0.5 AA |
| 4,808,224 | 2/1989 | Anderson et al. | 75/246 |
| 4,814,139 | 3/1989 | Tokunaga et al. | 419/12 |
| 4,826,546 | 5/1989 | Yamamoto et al. | 148/102 |
| 4,836,867 | 6/1989 | Sugawara et al. | 148/301 |
| 4,836,868 | 6/1989 | Yajima et al. | 148/302 |
| 4,837,114 | 6/1989 | Hamada et al. | 427/127 |
| 4,849,035 | 7/1989 | Stadelmaier et al. | 148/101 |
| 4,853,045 | 8/1989 | Rozendaal | 148/103 |
| 4,888,068 | 12/1989 | Tokunaga et al. | 148/104 |
| 4,891,078 | 1/1990 | Ghandehari | 148/301 |
| 4,898,613 | 2/1990 | Ishigaki et al. | 75/251 |
| 4,902,357 | 2/1990 | Imaizumi et al. | 148/101 |
| 4,911,882 | 3/1990 | Greenwald | 419/12 |
| 4,921,553 | 5/1990 | Tokunaga et al. | 148/302 |
| 4,933,025 | 6/1990 | Alson et al. | 148/104 |
| 4,952,239 | 8/1990 | Tokunaga et al. | 148/302 |
| 4,978,398 | 12/1990 | Iwasaki et al. | 148/101 |

OTHER PUBLICATIONS

Report by Prof. J. M. D. Coey, Intermag Conference, Brighton, England, Apr. 17-20, 1990, concerning presentation of paper: "Effects of Oxygen, Carbon and Nitrogen Content on the Corrosion Resistance and Nd-Fe-B Magnet", by A. S. Kim et al. Jul. 1, 1990.

Dialog Information Services Abstract Search, dated May 29, 1990.

"Reduction-Diffusion Preparation of $Sm_2(Co, Fe, Cu, Zr)_{17}$ Type Alloy Powders and Magnets Made from Them", by Dong Li et al., Paper No. X-1 at the Fifth Int. Workshop on Rare Earth-Cobalt Permanent Magnets and Their Applications, Roanoke, Virginia, Jun. 7-10, 1981.

"Rare Earth-Cobalt Permanent Magnets", by K. J. Strnat, Chapter 2, *Ferromagnetic Materials,* vol. 4, (1988).

"Auger Electron Spectroscopy", by A. Joshi, *Metals Handbook Ninth Edition,* vol. 10, pp. 549-554.

"Metallurgical Ways to NdFeB Alloys. Permanent Magnets from Co-Reduced NdFeB", by C. Herget, Paper No. V-7 at the 8th International Workshop on Rare-Earth Magnets and Their Applications, Dayton, Ohio, May 6-8, 1985.

"Reduction-Diffusion Preparation of Alloy Powders Based on Nd-Fe-B and Magnets Made Thereof", by S. X. Zhou et al., Paper at the 9th International Workshop on Rare Earth Magnets and Their Applications, Bad Soden, FRG, Aug. 31-Sep. 2, 1987.

SAMPLE YB-1

SAMPLE YB-2

SAMPLE YB-3

SAMPLE AE-1

SAMPLE D-1

SAMPLE D-4

SAMPLE W-1

SAMPLE W-2

SAMPLE W-3

SAMPLE W-4

MAGNETIC MATERIALS AND PROCESS FOR PRODUCING THE SAME

This is a divisional of co-pending application Ser. No. 07/535,460 filed on Jun. 8, 1990, now U.S. Pat. No. 5,122,203 which is a continuation-in-part of co-pending application Ser. No. 07/365,622, filed Jun. 13, 1989, now U.S. Pat. No. 5,114,502 the subject matter of which is incorporated herein by reference.

BACKGROUND OF THE INVENTION

1. Field of the Invention

This invention generally relates to magnetic materials and, more particularly, to rare earth-containing powders, compacts and permanent magnets, and a process for producing the same.

2. Description of the Prior Art

Permanent magnet materials currently in use include alnico, hard ferrite and rare earth/cobalt magnets. Recently, new magnetic materials have been introduced containing iron, various rare earth elements and boron. Such magnets have been prepared from melt quenched ribbons and also by the powder metallurgy technique of compacting and sintering, which was previously employed to produce samarium cobalt magnets.

Suggestions of the prior art for rare earth permanent magnets and processes for producing the same include: U.S. Pat. No. 4,597,938, Matsuura et al., which discloses a process for producing permanent magnet materials of the Fe-B-R type by: preparing a metallic powder having a mean particle size of 0.3–80 microns and a composition consisting essentially of, in atomic percent, 8–30% R representing at least one of the rare earth elements inclusive of Y, 2 to 28% B and the balance Fe; compacting; and sintering the resultant body at a temperature of 900°–1200° C. in a reducing or non-oxidizing atmosphere. Co up to 50 atomic percent may be present. Additional elements M (Ti, Ni, Bi, V, Nb, Ta, Cr, Mo, W, Mn, Al, Sb, Ge, Sn, Zr, Hf) may be present. The process is applicable for anisotropic and isotropic magnet materials. Additionally, U.S. Pat. No. 4,684,406, Matsuura et al., discloses a certain sintered permanent magnet material of the Fe-B-R type, which is prepared by the aforesaid process.

Also, U.S. Pat. No. 4,601,875, Yamamoto et al., teaches permanent magnet materials of the Fe-B-R type produced by: preparing a metallic powder having a mean particle size of 0.3–80 microns and a composition of, in atomic percent, 8–30% R representing at least one of the rare earth elements inclusive of Y, 2–28% B and the balance Fe; compacting; sintering at a temperature of 900°–1200° C.; and, thereafter, subjecting the sintered bodies to heat treatment at a temperature lying between the sintering temperature and 350° C. Co and additional elements M (Ti, Ni, Bi, V, Nb, Ta, Cr, Mo, W, Mn, Al, Sb, Ge, Sn, Zr, Hf) may be present. Furthermore, U.S. Pat. No. 4,802,931, Croat, discloses an alloy with hard magnetic properties having the basic formula $RE_{1-x}(TM_{1-y}B_y)_x$. In this formula, RE represents one or more rare earth elements including scandium and yttrium in Group IIIA of the periodic table and the elements from atomic number 57 (lanthanum) through 71 (lutetium). TM in this formula represents a transition metal taken from the group consisting of iron or iron mixed with cobalt, or iron and small amounts of other metals such as nickel, chromium or manganese.

However, prior art attempts to manufacture permanent magnets utilizing powder metallurgy technology have suffered from substantial shortcomings. For example, crushing is typically carried out in a crushing apparatus using an organic liquid in a gas environment. This liquid may be, for example, hexane, petroleum ether, glycerin, methanol, toluene, or other suitable liquid. A special liquid environment is utilized since the powder produced during crushing is rare earth metal based and, accordingly, the powder is chemically active, pyrophoric and readily oxidizable. However, the aforementioned liquids are relatively costly and pose a potential health hazard due to their toxicity and flammability. Furthermore, crushing an alloy mass to make suitable powder in the aforementioned environment is also disadvantageous since the powder produced has a high density of certain defects in the crystal structure which adversely affect the magnetic properties. Additionally, crushing in the organic liquid environment unduly complicates the attainment of the desired shape, size, structure, magnetic field orientation and magnetic properties of the powders and resultant magnets since the organic liquid environments have a relatively high viscosity which interferes with achieving the desired results. Moreover, attempts to passivate the surfaces of the powder particles by coating them with a protective substance, such as a resin, nickel or the like, during and after crushing is a generally ineffective and complicated process which increases the cost of manufacturing.

SUMMARY OF THE INVENTION

This invention relates to a process for producing a rare earth-containing material capable of being formed into a permanent magnet comprising crushing a rare earth-containing alloy and treating the alloy with a passivating gas at a temperature below the phase transformation temperature of the alloy. This invention further relates to a process for producing a rare earth-containing powder comprising crushing a rare earth-containing alloy in a passivating gas at a temperature from ambient temperature to a temperature below the phase transformation temperature of the material.

This invention also relates to a process for producing a rare earth-containing powder comprising crushing an alloy in water, drying the crushed alloy material at a temperature below the phase transformation temperature of the material, and treating the crushed alloy material with a passivating gas at a temperature from the ambient temperature to a temperature below the phase transformation temperature of the material. Additionally, this invention relates to a process for producing a rare earth-containing powder compact comprising crushing a rare earth-containing alloy in water, compacting the crushed alloy material, drying the compacted alloy material at a temperature below the phase transformation temperature of the material, and treating the compacted alloy material with a passivating gas at a temperature from ambient temperature to a temperature below the phase transformation temperature of the material.

The alloy can comprise, in atomic percent of the overall composition, from about 12% to about 24% of at least one rare earth element selected from the group consisting of neodymium, praseodymium, lanthanum, cerium, terbium, dysprosium, holmium, erbium, europium, samarium, gadolinium, promethium, thulium, ytterbium, lutetium, yttrium, and scandium, from about 2% to about 28% boron and the balance iron. Other rare earth-containing alloys suitable for use in producing permanent magnets utilizing the powder metallurgy technique, such as samarium cobalt alloy, can also be used.

The alloys are crushed to a particle size of from about 0.05 microns to about 100 microns and, preferably, to a particle size of from 1 micron to 40 microns. If the alloys are crushed in water, the crushed or compacted alloy material can be vacuum dried or dried with an inert gas, such as argon or helium. The passivating gas can be nitrogen, carbon dioxide or a combination of nitrogen and carbon dioxide. If nitrogen is used as the passivating gas, the resultant powder or compact has a nitrogen surface concentration of from about 0.4 to about 26.8 atomic percent. Moreover, if carbon dioxide is used as the passivating gas, the resultant powder or compact has a carbon surface concentration of from about 0.02 to about 15 atomic percent. The rare earth-containing powder and powder compact produced in accordance with the present invention are non-pyrophoric and resistant to oxidation. Furthermore, the excellent properties displayed by the powders of this invention make them suitable for use in producing magnets, such as bonded or pressed magnets.

The present invention further relates to the production of an improved permanent magnet comprising the steps for producing the rare earth-containing powder set forth above and then compacting the crushed alloy material, sintering the compacted alloy material at a temperature of from about 900° C. to about 1200° C., and heat treating the sintered material at a temperature of from about 200° C. to about 1050° C.

The present invention also relates to the production of an improved permanent magnet comprising the steps for producing the rare earth-containing powder compact set forth above and then sintering the compacted alloy material at a temperature of from about 900° C. to about 1200° C., and heat treating the sintered material at a temperature of from about 200° C. to about 1050° C.

The improved permanent magnet in accordance with the present invention includes the type of magnet comprised of, in atomic percent of the overall composition, from 12% to 24% of at least one rare earth element selected from the group consisting of neodymium, praseodymium, lanthanum, cerium, terbium, dysprosium, holmium, erbium, europium, samarium, gadolinium, promethium, thulium, ytterbium, lutetium, yttrium, and scandium, from about 2% to about 28% boron and at least 52% iron, wherein the improvement comprises a nitrogen surface concentration of from about 0.4 to about 26.8 atomic percent. The improved permanent magnet can also have a carbon surface concentration of from about 0.02 to about 15 atomic percent if carbon dioxide is used as a passivating gas. These improved permanent magnets have a high resistance to corrosion and superior magnetic properties.

Accordingly, it is an object of the present invention to provide processes for producing rare earth-containing powder and powder compacts which are resistant to oxidation and are non-pyrophoric. It is a further object of the present invention to provide a safe and economically effective process for producing rare earth-containing powder, compacts and magnets. It is also an object of the present invention to provide improved permanent magnets having high resistance to corrosion and superior magnetic properties. These and other objects and advantages of the present invention will be apparent to those skilled in the art upon reference to the following description of the preferred embodiments.

DESCRIPTION OF THE PREFERRED EMBODIMENTS

Figure 1:
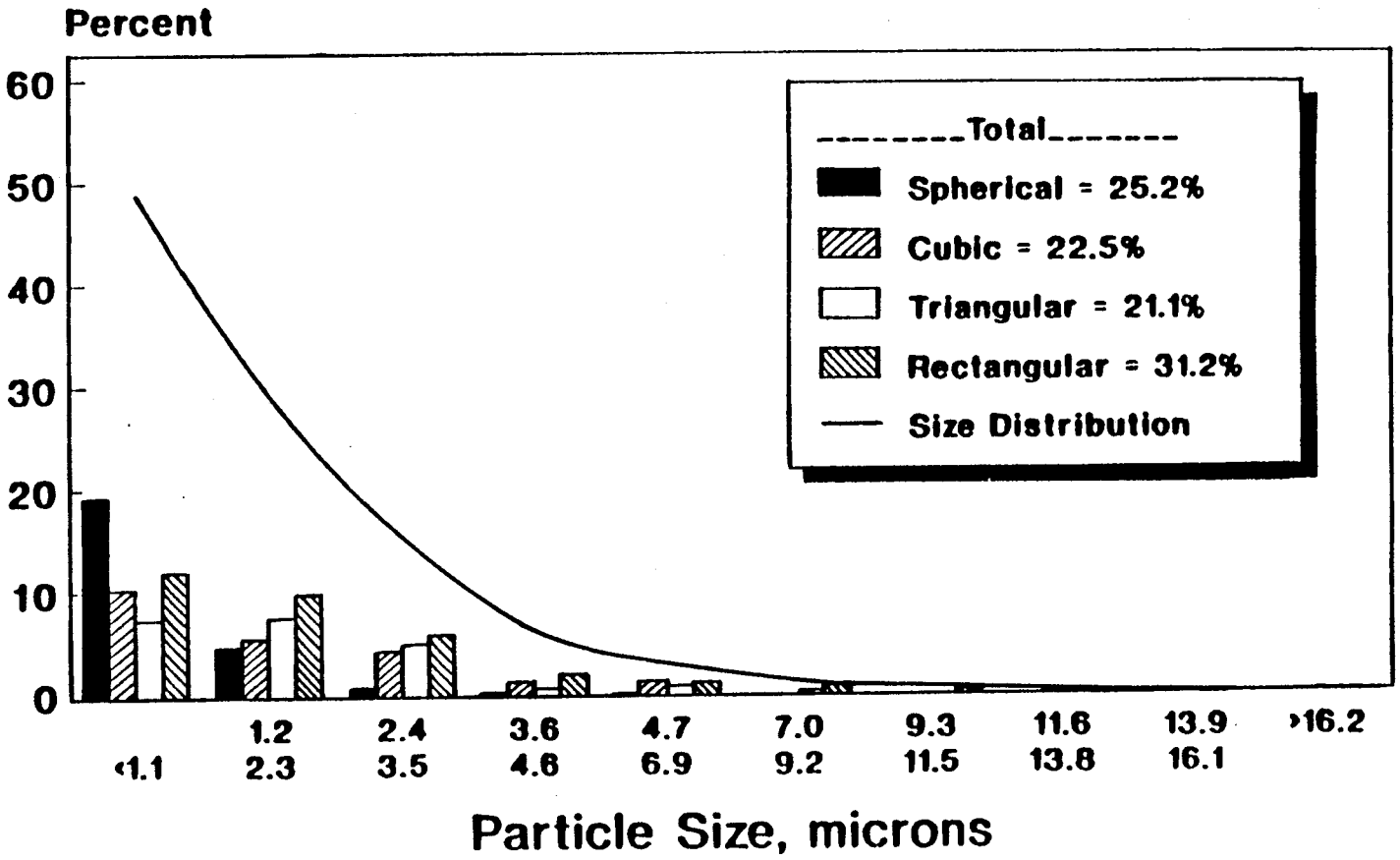
FIG. 1 is a graph showing the particle size and shape distribution for Nd-Fe-B powder produced in accordance with the present invention with $P_a/P_b$ of 1:16 and grinding time of 30 minutes.
Figure 2:
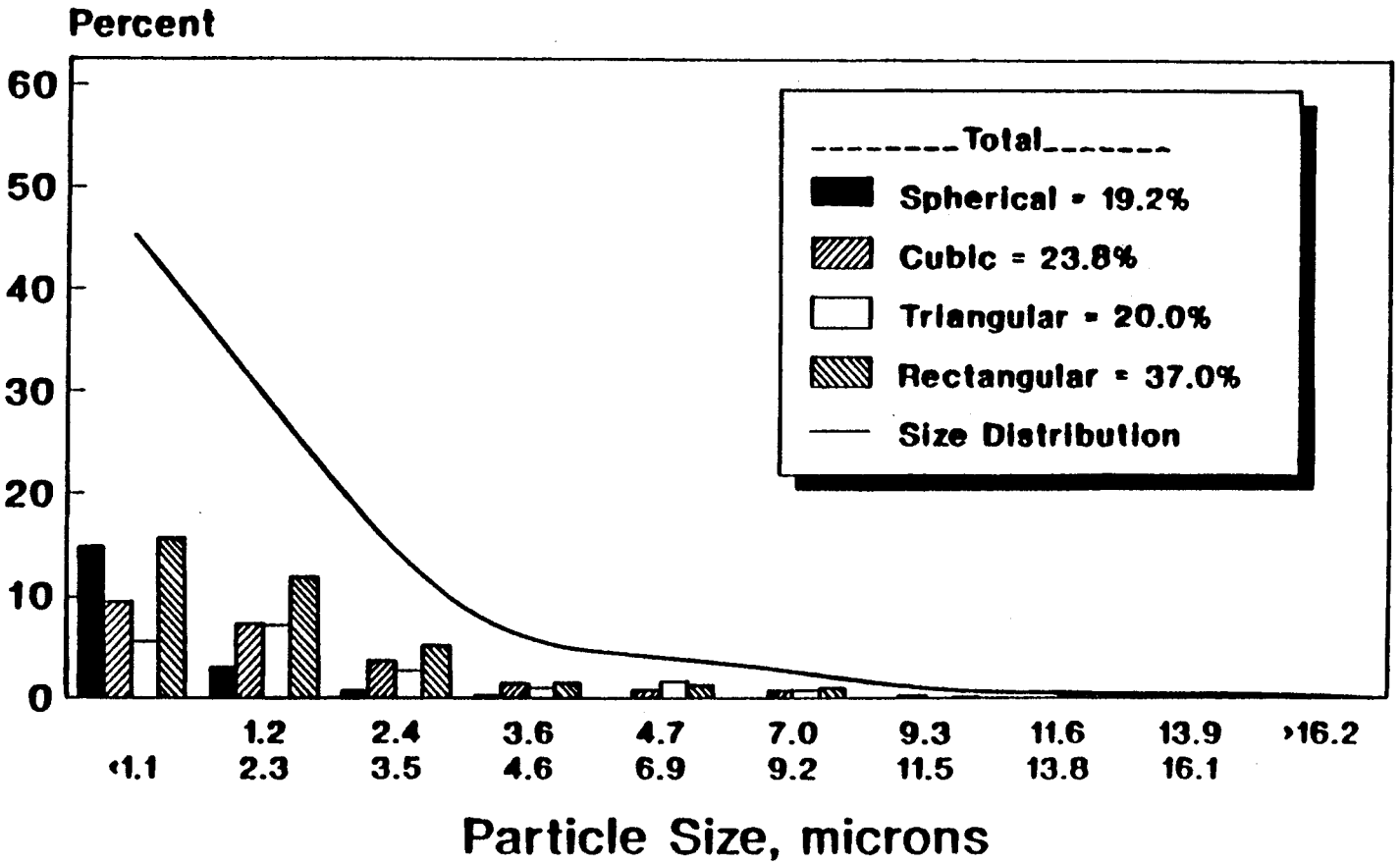
FIG. 2 is a graph showing the particle size and shape distribution for Nd-Fe-B powder produced in accordance with the present invention with $P_a/P_b$ of 1:16 and grinding time of 60 minutes.
Figure 3:
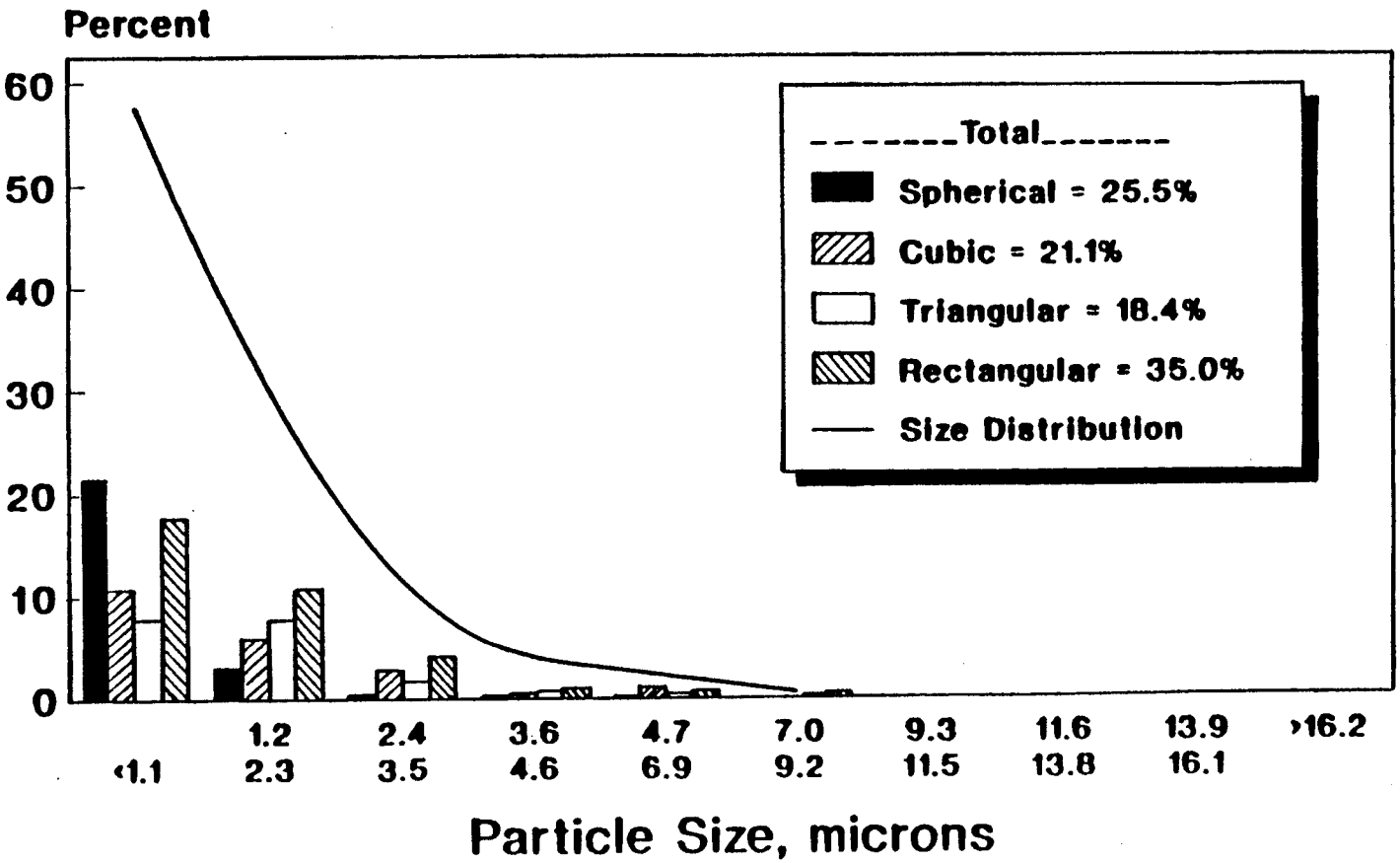
FIG. 3 is a graph showing the particle size and shape distribution for Nd-Fe-B powder produced in accordance with the present invention with $P_a/P_b$ of 1:6 and grinding time of 90 minutes.
Figure 4:
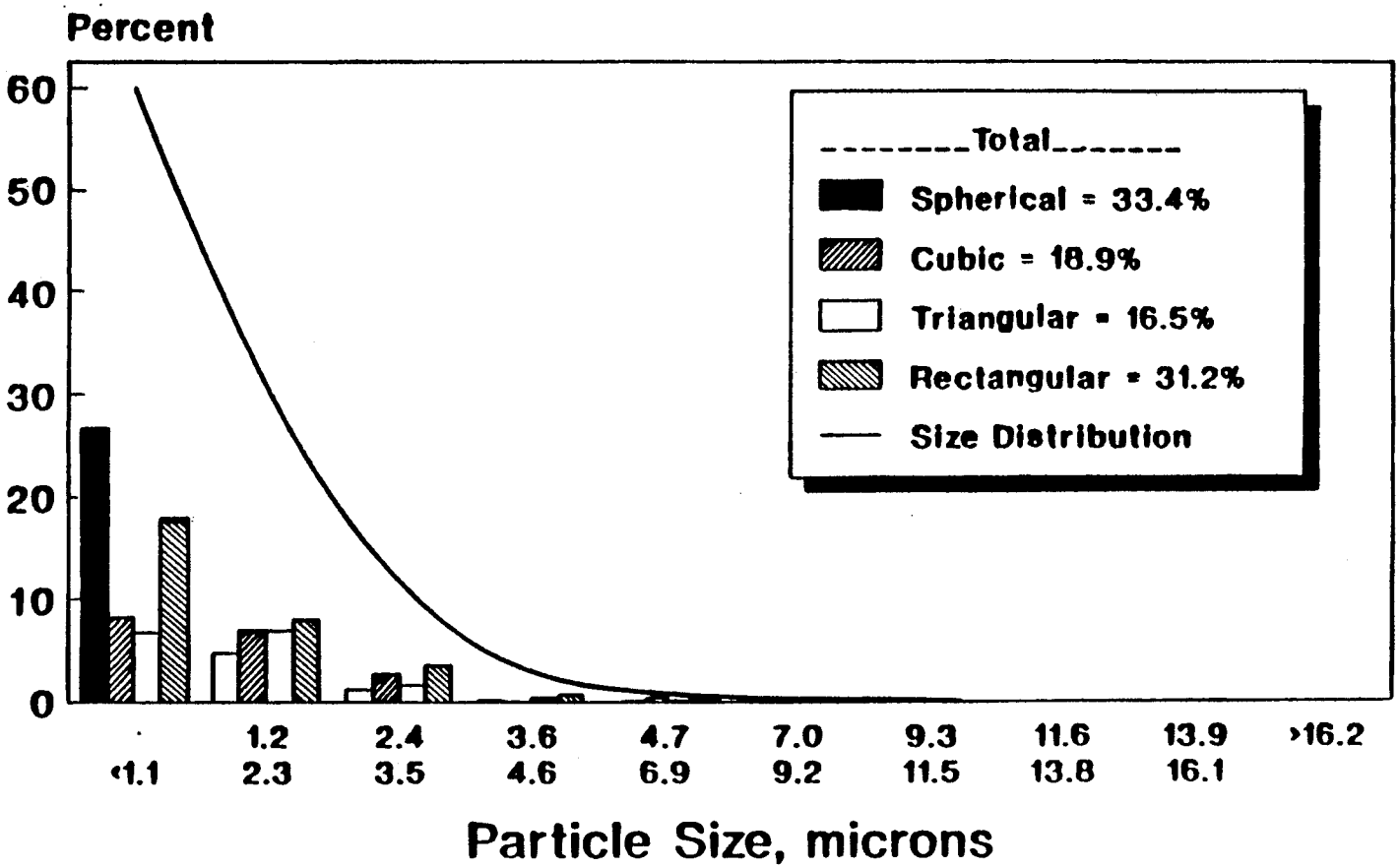
FIG. 4 is a graph showing the particle size and shape distribution for Nd-Fe-B powder produced in accordance with the present invention with $P_a/P_b$ of 1:16 and grinding time of 120 minutes.
Figure 5:
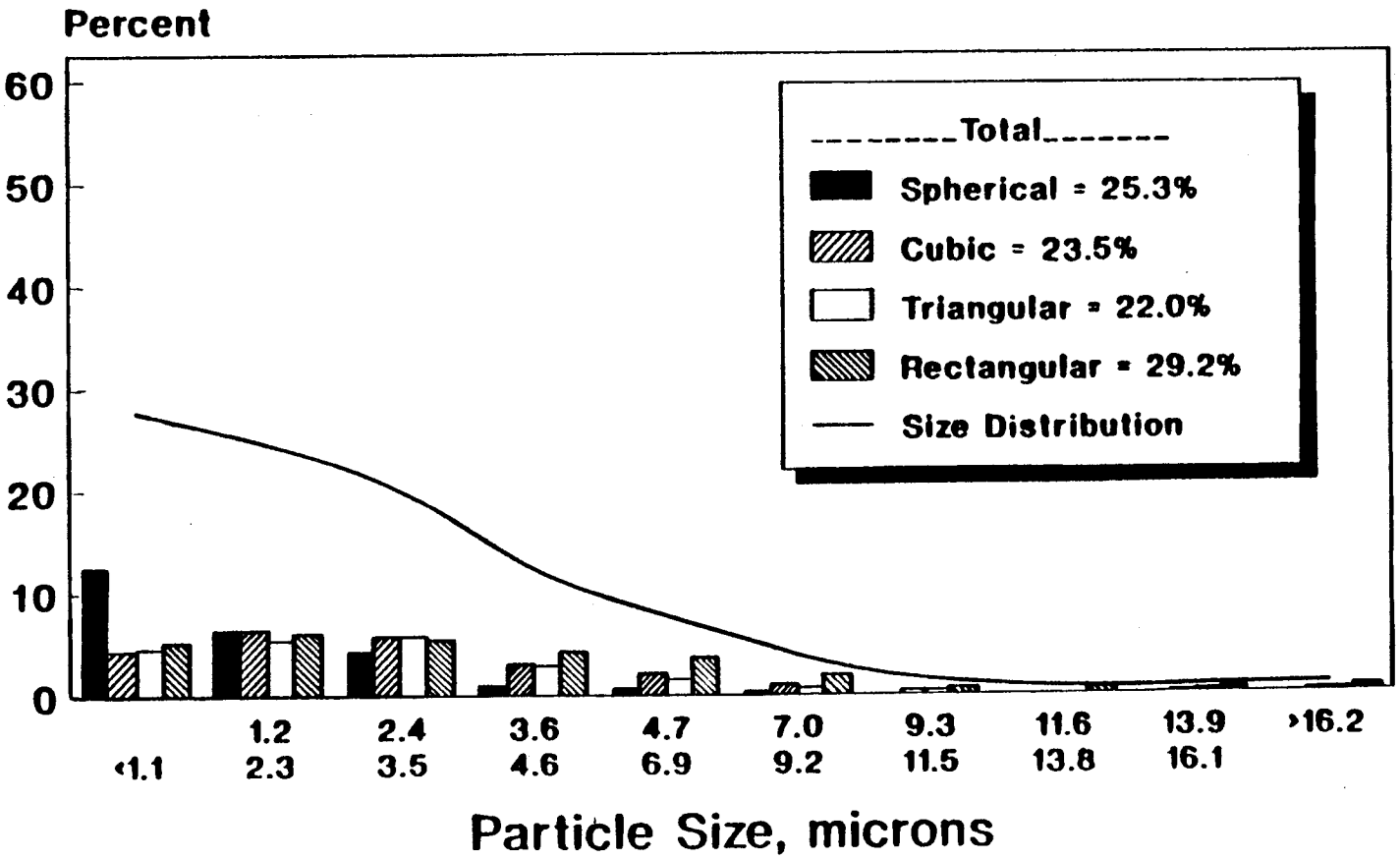
FIG. 5 is a graph showing the particle size and shape distribution for Nd-Fe-B powder produced in accordance with the present invention with $P_a/P_b$ of 1:24 and grinding time of 15 minutes.
Figure 6:
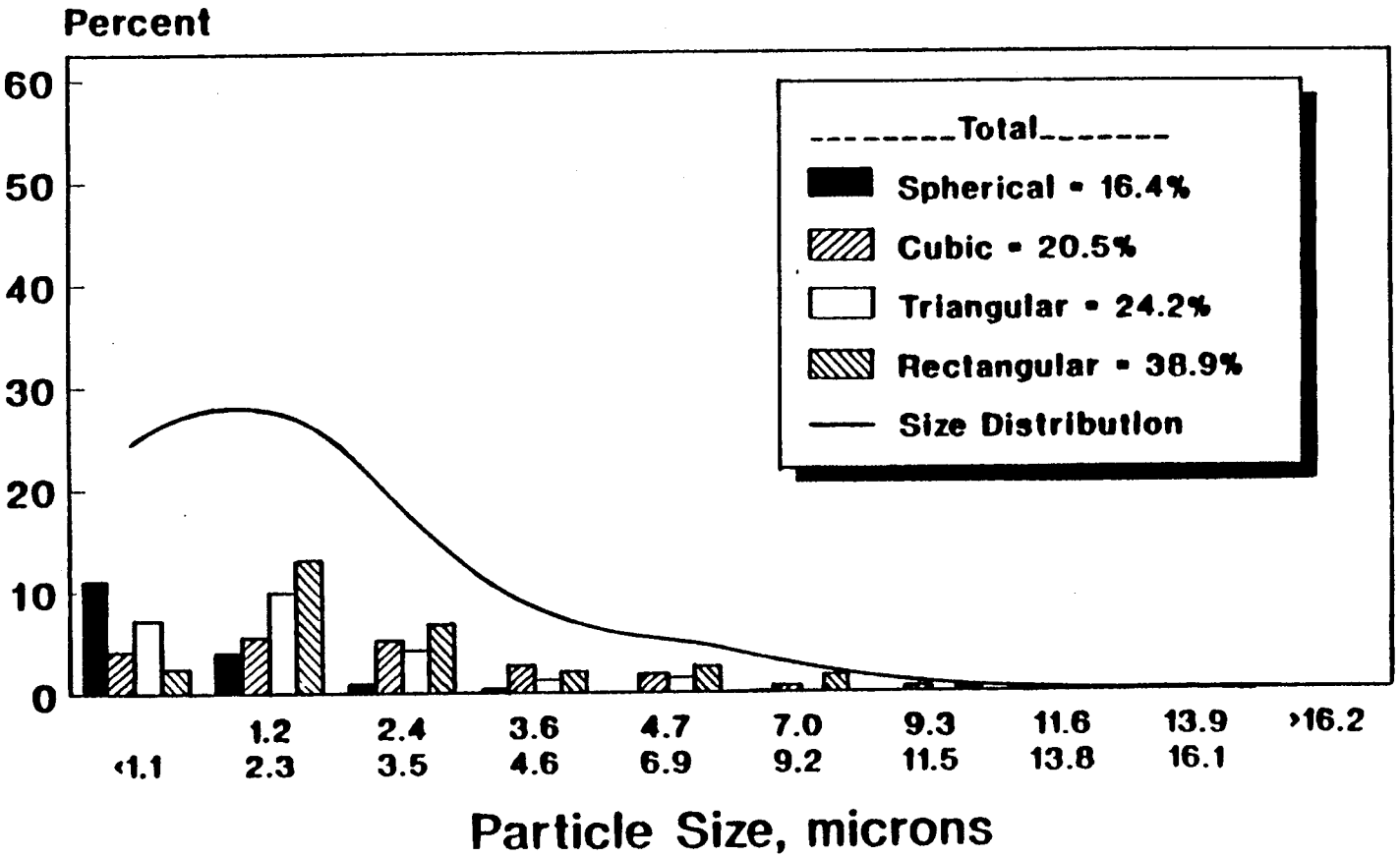
FIG. 6 is a graph showing the particle size and shape distribution for Nd-Fe-B powder produced in accordance with the present invention with $P_a/P_b$ of 1:24 and grinding time of 30 minutes.
Figure 7:
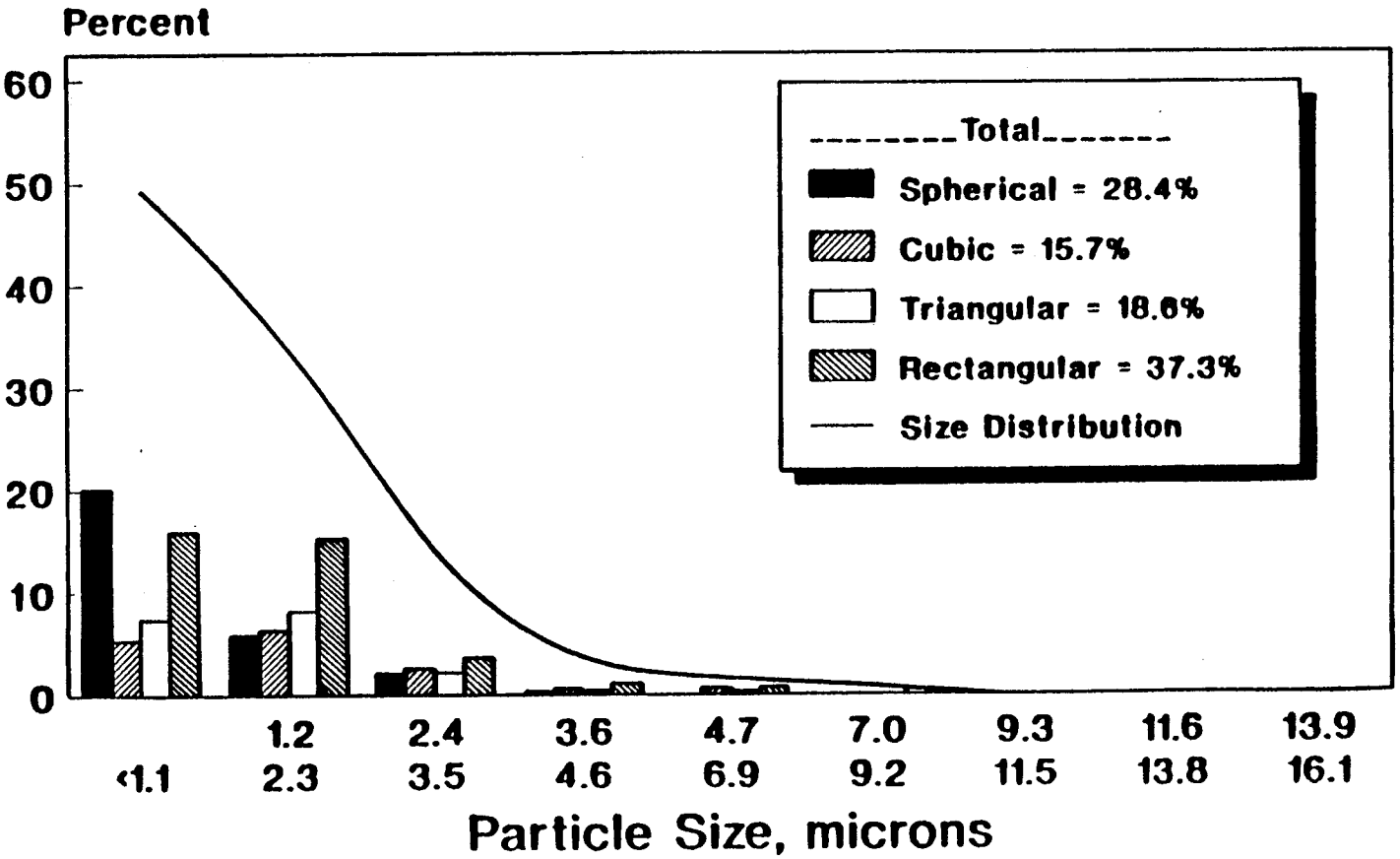
FIG. 7 is a graph showing the particle size and shape distribution for Nd-Fe-B powder produced in accordance with the present invention with $P_a/P_b$ of 1:24 and grinding time of 60 minutes.
Figure 8:
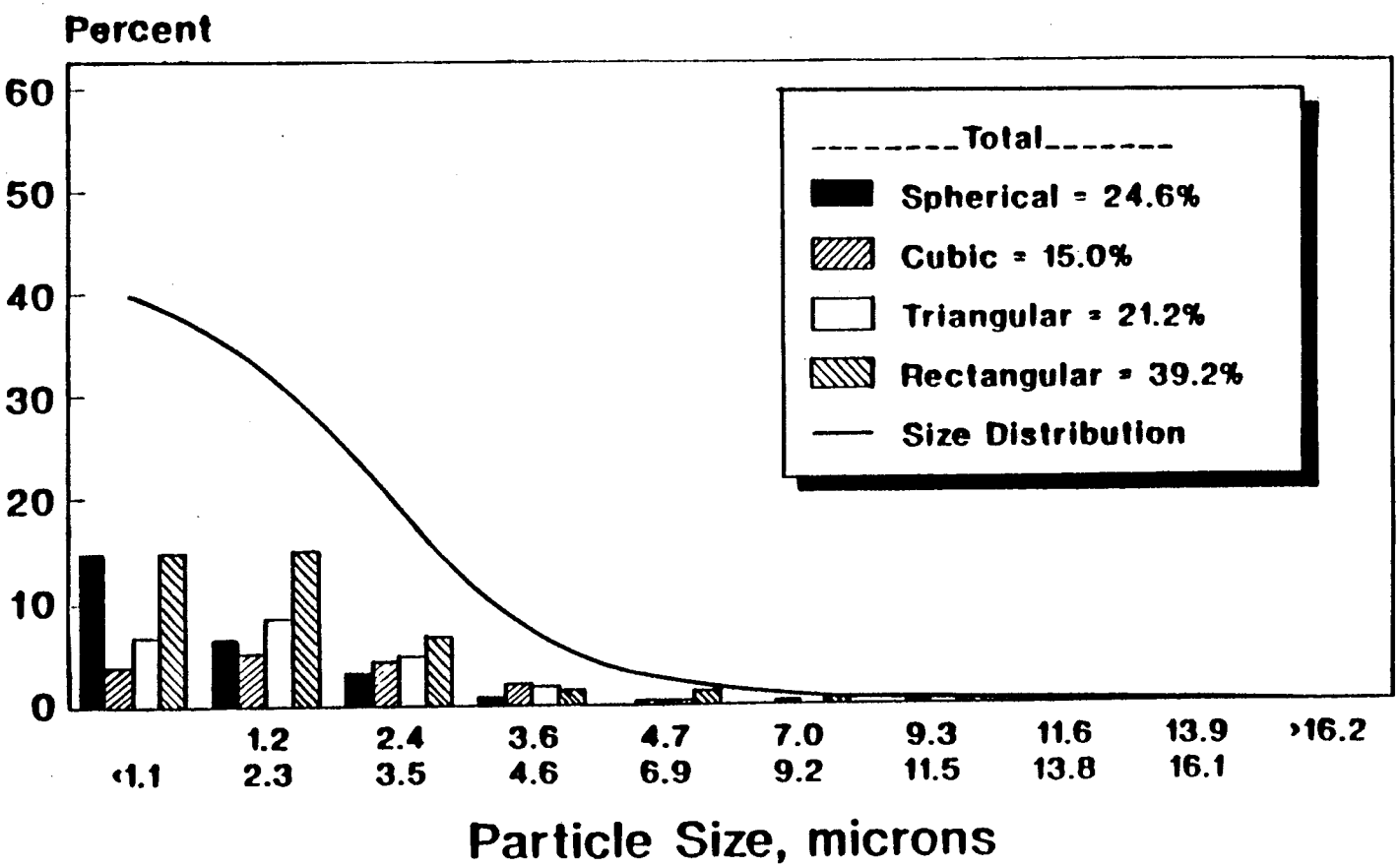
FIG. 8 is a graph showing the particle size and shape distribution for Nd-Fe-B powder produced in accordance with the present invention with $P_a/P_b$ of 1:24 and grinding time of 90 minutes.
Figure 9:
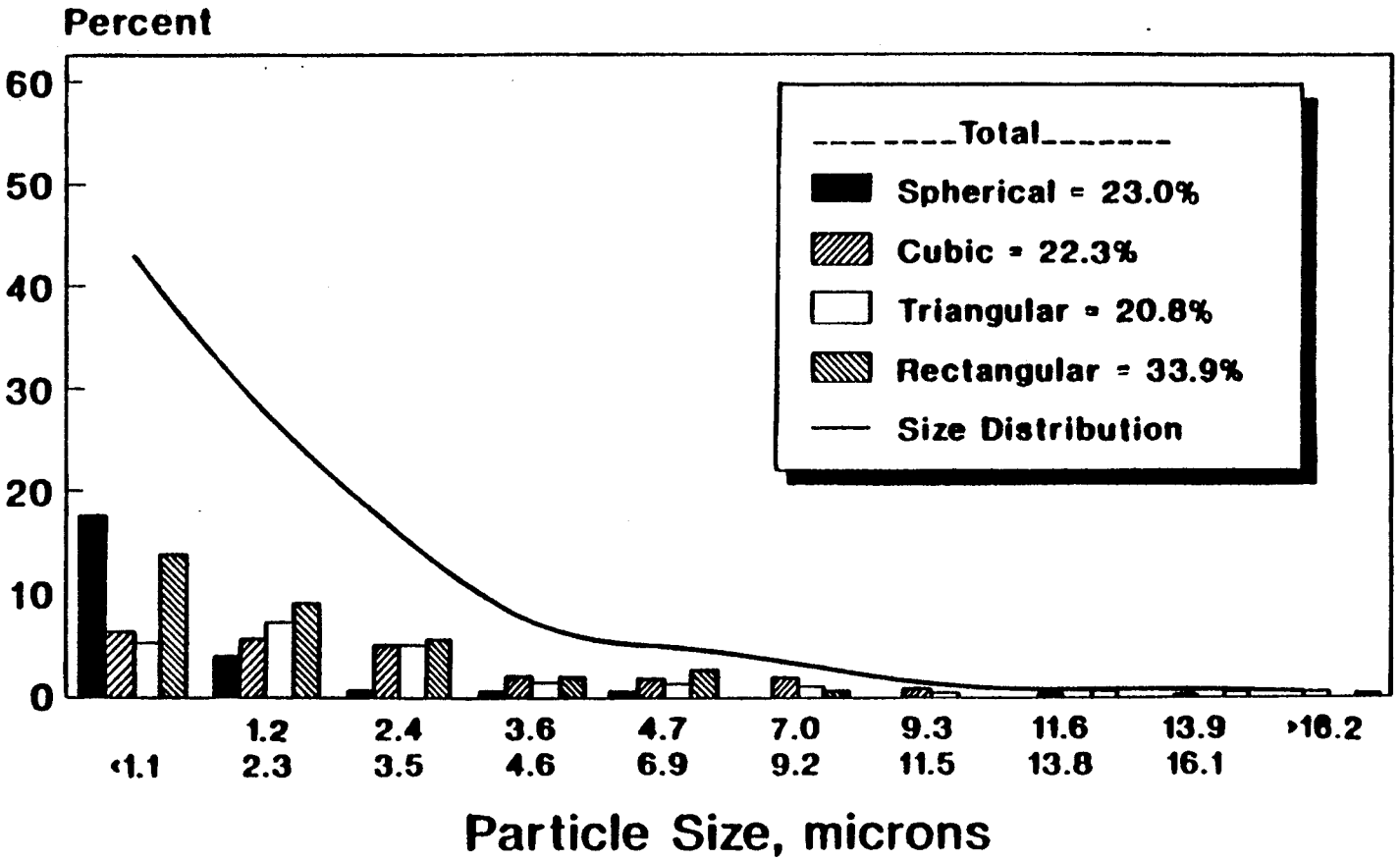
FIG. 9 is a graph showing the particle size and shape distribution for Nd-Fe-B powder produced in accordance with the present invention with $P_a/P_b$ of 1:32 and grinding time of 15 minutes.
Figure 10:
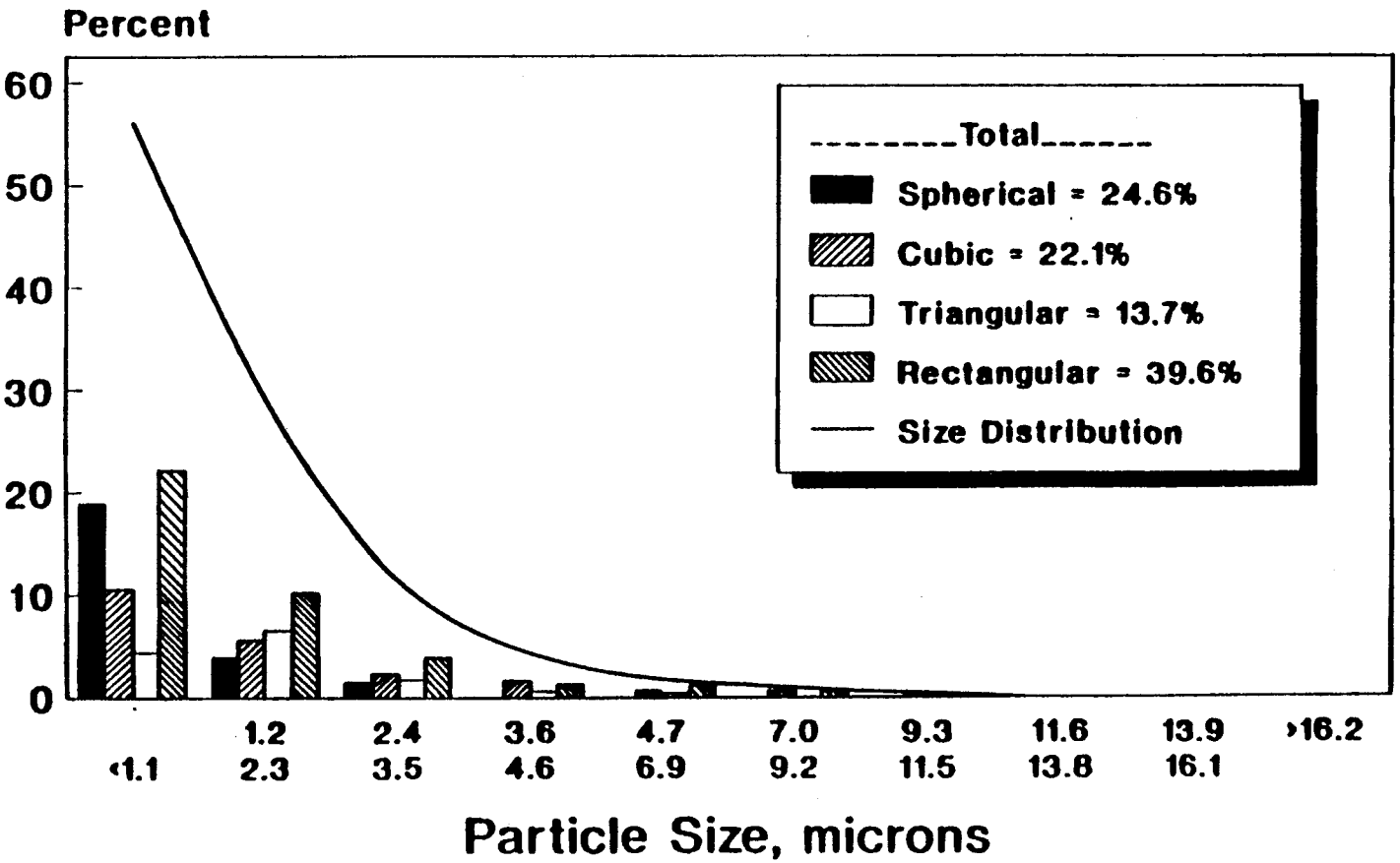
FIG. 10 is a graph showing the particle size and shape distribution for Nd-Fe-B powder produced in accordance with the present invention with $P_a/P_b$ of 1:32 and grinding time of 30 minutes.
Figure 11:
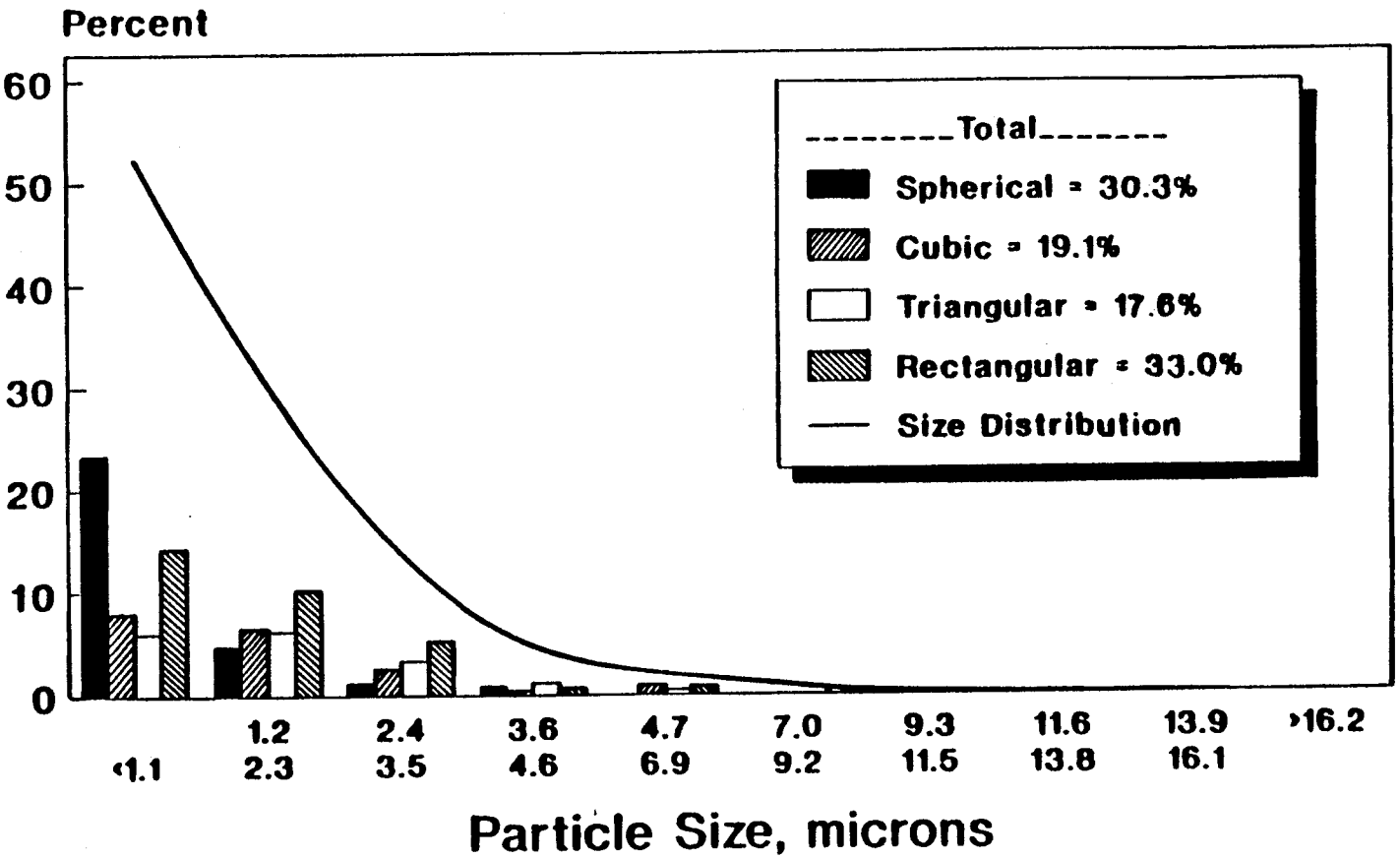
FIG. 11 is a graph showing the particle size and shape distribution for Nd-Fe-B powder produced in accordance with the present invention with $P_a/P_b$ of 1:32 and grinding time of 60 minutes.

In one aspect, the present invention relates to a process for producing a rare earth-containing material capable of being formed into a permanent magnet comprising crushing a rare earth-containing alloy and treating the alloy with a passivating gas at a temperature below the phase transformation temperature of the material. In a further aspect, the present invention relates to a process for producing a rare earth-containing powder comprising crushing a rare earth-containing alloy in a passivating gas at a temperature from ambient temperature to a temperature below the phase transformation temperature of the material.

In another aspect, the present invention relates to a process for producing a rare earth-containing powder comprising: crushing a rare earth-containing alloy in water; drying the crushed alloy material at a temperature below the phase transformation temperature of the material; and treating the crushed alloy material with a passivating gas at a temperature from ambient temperature to a temperature below the phase transformation temperature of the material. The present invention further relates to a process for producing a permanent magnet comprising the above-mentioned processing steps to produce a powder and then performing the additional steps of compacting the crushed alloy material, sintering the compacted alloy material at a temperature of from about 900° C. to about 1200° C., and heat treating the sintered material at a temperature of from about 200° C. to about 1050° C.

In still another aspect, the present invention relates to a process for producing a rare earth-containing powder compact comprising: crushing a rare earth-containing alloy in water; compacting the crushed alloy material; drying the compacted alloy material at a temperature below the phase transformation temperature of the material; and treating the compacted alloy material with a passivating gas at a temperature from ambient temperature to a temperature below the phase transformation temperature of the material. Additionally, this invention relates to a process for producing a permanent magnet comprising the above-mentioned processing steps to produce a powder compact and then performing the additional steps of sintering the compacted alloy material at a temperature of from about 900° C. to about 1200° C., and heat treating the sintered material at a temperature of from about 200° C. to about 1050° C.

The first processing step of the instant invention involves placing an ingot or piece of a rare earth-containing alloy in a crushing apparatus and crushing the alloy. The crushing can occur in either water or a passivating gas. It is believed that any rare earth-containing alloy suitable for producing powders, compacts and permanent magnets by the conventional powder metallurgy method can be utilized. For example, the alloy can have a base composition of: R-Fe-B, R-Co-B, and R-(Co,Fe)-B wherein R is at least one of the rare earth metals, such as Nd-Fe-B; $RCo_5$, $R(Fe,Co)_5$, and $RFe_5$, such as $SmCo_5$; $R_2Co_{17}$, $R_2(Fe,Co)_{17}$, and $R_2Fe_{17}$, such as $Sm_2Co_{17}$; mischmetal-Co, mischmetal-Fe and mischmetal-(Co,Fe); Y-Co, Y-Fe and Y-(Co,Fe); or other similar alloys known in the art. The R-Fe-B alloy compositions disclosed in U.S. Pat. Nos. 4,597,938 and 4,802,931, the texts of which are incorporated by reference herein, are particularly suitable for use in accordance with the present invention.

In one preferred embodiment, the rare earth-containing alloy comprises, in atomic percent of the overall composition, from about 12% to about 24% of at least one rare earth element selected from the group consisting of neodymium, praseodymium, lanthanum, cerium, terbium, dysprosium, holmium, erbium, europium, samarium, gadolinium, promethium, thulium, ytterbium, lutetium, yttrium, and scandium, from about 2% to about 28% boron and the balance iron. Preferably, the rare earth element is neodymium and/or praseodymium. However, $RM_5$ and $R_2M_{17}$ type rare earth alloys, wherein R is at least one rare earth element selected from the group defined above and M is at least one metal selected from the group consisting of Co, Fe, Ni, and Mn may be utilized. Additional elements Cu, Ti, Bi, V, Nb, Ta, Cr, Mo, W, Mn, Al, Sb, Ge, Sn, Zr and Hf, may also be utilized. $RCo_5$ and $R_2Co_{17}$ are preferred for this type. The alloys, as well as the powders, compacts and magnets produced therefrom in accordance with the present invention, may contain, in addition to the above-mentioned base compositions, impurities which are entrained from the industrial process of production.

In one embodiment, the alloys are crushed in water to produce particles having a particle size of from about 0.05 microns to about 100 microns and, preferably, from 1 micron to 40 microns, although larger size particles, such as up to about 300 microns, can also be utilized. Advantageously, the particle size is from 2 to 20 microns. The time required for crushing is not critical and will, of course, depend upon the efficiency of the crushing apparatus. The crushing is performed in water to prevent oxidation of the crushed alloy material. Furthermore, water has a low coefficient of viscosity and, therefore, crushing in water is more effective and faster than crushing in organic liquids presently utilized in the art. Also, crushing in water provides a higher defect density of domain wall pinning sites in the individual alloy particles, thereby providing better magnetic properties for the magnets produced from the powder or powder compact. Finally, the size and shape of the individual alloy particles is optimized for compacting of the powder in a magnetic field to produce magnets. The type of water utilized is not critical. For example, distilled, deionized or non-distilled water may be utilized, but distilled is preferred.

In the aforesaid embodiment, after crushing, the crushed alloy material is then dried at a temperature below the phase transformation temperature of the material. More particularly, the crushed alloy material is dried thoroughly at a temperature which is sufficiently low so that phase transformation of the alloy material is not induced. The term "phase transformation temperature" as used herein means the temperature at which the stoichiometry and crystal structure of the base rare earth-containing alloy changes to a different stoichiometry and crystal structure. For example, crushed alloy material having a base composition of Nd-Fe-B will undergo phase transformation at a temperature of approximately 580° C. Accordingly, the Nd-Fe-B crushed alloy material should be dried at a temperature below about 580° C. However, as can be appreciated by those skilled in the art, the particular phase transformation temperature necessary for the alloy material utilized will vary depending on the exact composition of the material and this temperature can be determined experimentally for each such composition.

Preferably, the wet crushed alloy material is first put in a centrifuge or other appropriate equipment for quickly removing most of the water from the material. The material can then be vacuum dried or dried with an inert gas, such as argon or helium. The crushed alloy material can be effectively dried by the flow or injection of the inert gas at a pressure below 760 torr. Nevertheless, regardless of the drying technique, the drying must be performed at a temperature below the aforementioned phase transformation temperature of the material.

In another embodiment, after crushing, the crushed alloy material is first compacted before drying to form wet compacted material. Preferably, the material is compacted at a pressure of 0.5 to 12 $T/cm^2$. Nevertheless, the pressure for compaction is not critical. However, the resultant compact should have interconnected porosity and sufficient green strength to enable the compact to be handled. Advantageously, the interconnected porosity can be obtained during drying of the compact. The term "interconnected porosity" as used herein means a network of connecting pores is present in the compact in order to permit a fluid or gas to pass through the compact. The compaction is performed in a magnetic field to produce anisotropic permanent magnets. Preferably, a magnetic field of about 7 to 15 kOe is applied in order to align the particles. Moreover, a magnetic field is not applied during compaction when producing isotropic permanent magnets. In either case, the compacted alloy material can be thereafter dried at a temperature below the phase transformation temperature of the material as described above. However, the compaction and drying steps can be combined if desired so that the compaction and drying occur simultaneously. Furthermore, it is believed that the compaction and drying steps can even be reversed (i.e. dry the crushed alloy material first and then compact the material) if a protective atmosphere is provided until the compact is treated with a passivating gas.

Subsequently, the crushed or compacted alloy material is treated with a passivating gas at a temperature from ambient temperature to a temperature below the phase transformation temperature of the material. If the wet crushed or compacted material was dried in a vacuum box, then the material can be treated with the passivating gas by injecting the gas into the box. The term "passivating gas" as used herein means a gas suitable for passivation of the surface of the crushed material, powder or compacted powder particles so as to produce a thin layer on the surface of the particles in order to protect it from corrosion and/or oxidation. The passivating gas can be nitrogen, carbon dioxide or a combination of nitrogen and carbon dioxide. The temperature at which the powder or compacted powder particles is treated is critical and must be below the phase transformation temperature of the material. For example, the maximum temperature for treatment must be below about 580° C. when a Nd-Fe-B composition is used for the material. Generally, the higher the temperature, the less the time required for treatment with the passivating gas, and the smaller the particle size of the material, the lower the temperature and the shorter the time required for treatment. Preferably, crushed or compacted alloy material of the Nd-Fe-B type is treated with the passivating gas from about one minute to about 60 minutes at a temperature from about 20° C. to about 580° C. and, advantageously, at a temperature of about 175° C. to 225° C.

In another embodiment of the present invention, the powder is produced by placing an ingot or piece of the rare earth-containing alloy in a crushing apparatus, such as an attritor or ball mill, and then purging the apparatus with a passivating gas to displace the air in the apparatus. The alloy is crushed in the passivating gas to a particle size of from about 0.05 microns to about 100 microns and, preferably, from 1 micron to 40 microns, although larger size particles, such as up to about 300 microns, can also be utilized. The time required for crushing is not critical and will, of course, depend upon the efficiency of the crushing apparatus. Furthermore, the crushing apparatus may be set-up to provide a continuous operation for crushing the alloy in a passivating gas. However, the temperature at which the alloy material is crushed in passivating gas is critical and must be below the phase transformation temperature of the material as defined above. Additionally, the passivating gas pressure and the amount of time the alloy material is crushed in the passivating gas must be sufficient to obtain the nitrogen or carbon surface concentration in the resultant powder and magnet as noted below.

When nitrogen is used as the passivating gas in accordance with the present invention, the resultant powder or powder compact has a nitrogen surface concentration of from about 0.4 to about 26.8 atomic percent and, preferably, 0.4 to 10.8 atomic percent. Furthermore, when carbon dioxide is used as the passivating gas, the resultant powder or powder compact has a carbon surface concentration of from about 0.02 to about 15 atomic percent and, preferably, 0.5 to 6.5 atomic percent. When a combination of nitrogen and carbon dioxide is utilized, the resultant powder or powder compact can have a nitrogen surface concentration and carbon surface concentration within the abovestated ranges.

The term "surface concentration" as used herein means the concentration of a particular element in the region extending from the surface to a depth of 25% of the distance between the center of the particle and surface. For example, the surface concentration for a particle having a size of 5 microns will be the region extending from the surface to a depth of 0.625 microns. Preferably, the region extends from the surface to a depth of 10% of the distance between the center of the particle and surface. This surface concentration can be measured by Auger electron spectroscopy (AES), as can be appreciated by those skilled in the art. AES is a surface-sensitive analytical technique involving precise measurements of the number of emitted secondary electrons as a function of kinetic energy. More particularly, there is a functional dependence of the electron escape depth on the kinetic energy of the electrons in various elements. In the energy range of interest, the escape depth varies in the 2 to 10 monolayers regime. The spectral information contained in the Auger spectra are thus to a greater extent representative of the top 0.5 to 3 nm of the surface. See Metals Handbook®, Ninth Edition, Volume 10, Materials Characterization, American Society for Metals, pages 550–554 (1986), which is incorporated by reference herein.

In a preferred embodiment, the present invention further provides for an unique non-pyrophoric rare earth-containing powder and powder compact comprising, in atomic percent of the overall composition, from about 12% to about 24% of at least one rare earth element selected from the group consisting of neodymium, praseodymium, lanthanum, cerium, terbium, dysprosium, holmium, erbium, europium, samarium, gadolinium, promethium, thulium, ytterbium, lutetium, yttrium, and scandium, from about 2% to about 28% boron and at least 52% iron, and further having a nitrogen surface concentration of from about 0.4 to about 26.8 atomic percent. Preferably, the rare earth element of the alloy powder or powder compact is neodymium and/or praseodymium and the nitrogen surface concentration is from 0.4 to 10.8 atomic percent. In another preferred embodiment, the present invention provides for an unique non-pyrophoric rare earth-containing powder and powder compact comprising, in atomic percent of the overall composition, from 12% to 24% of at least one rare earth element, selected from the group consisting of neodymium, praseodymium, lanthanum, cerium, terbium, dysprosium, holmium, erbium, europium, samarium, gadolinium, promethium, thulium, ytterbium, lutetium, yttrium, and scandium, from about 2% to about 28% boron and at least 52% iron, and further having a carbon surface concentration of from about 0.02 to about 15 atomic percent. Preferably, the rare earth element is neodymium and/or praseodymium and the carbon surface concentration is from 0.5 to 6.5 atomic percent. The above-mentioned rare earth-containing powders and powder compacts are not only non-pyrophoric, but also resistant to oxidation and can be used to produce permanent magnets having superior magnetic properties.

The present invention further encompasses a process for producing a permanent magnet. In one embodiment, this process comprises:

a) crushing a rare earth-containing alloy in a passivating gas for about 1 minute to about 60 minutes at a temperature from about 20° C. to about 580° C. to a particle size of from about 0.05 microns to about 100 microns, said alloy comprising, in atomic percent of the overall composition, of from about 12% to about 24% of at least one rare earth element selected from the group consisting of neodymium, praseodymium, lanthanum, cerium, terbium, dysprosium, holmium, erbium, europium, samarium, gadolinium, promethium, thulium, ytterbium, lutetium, yttrium, and scandium, from about 2% to about 28% boron and the balance iron;
b) compacting the crushed alloy material;
c) sintering the compacted alloy material at a temperature of from about 900° C. to about 1200° C.; and
d) heat treating the sintered material at a temperature from about 200° C. to about 1050° C.

The crushing step (step a) is the same as disclosed above for producing powder when the alloy is crushed in a passivating gas.

In a further embodiment, the process for producing a permanent magnet in accordance with the present invention comprises:

a) Crushing a rare earth-containing alloy in water to a particle size of from about 0.05 microns to about 100 microns, the rare earth-containing alloy comprising, in atomic percent of the overall composition, of from about 12% to about 24% of at least one rare earth element selected from the group consisting of neodymium, praseodymium, lanthanum, cerium, terbium, dysprosium, holmium, erbium, europium, samarium, gadolinium, promethium, thulium, ytterbium, lutetium, yttrium, and scandium, from about 2% to about 28% boron and the balance iron;

b) Drying the crushed alloy material at a temperature below the phase transformation temperature of the material;

c) Treating the crushed alloy material with a passivating gas from about 1 minute to 60 minutes at a temperature of from about 20° C. to 580° C.;

d) Compacting the crushed alloy material;

e) Sintering the compacted alloy material at a temperature of from about 900° C. to about 1200° C.; and f) Heat treating the sintered material at a temperature of from about 200° C. to about 1050° C.

The crushing, drying, and treating steps (steps a through c) are the same as disclosed above for producing powder when the alloy is crushed in water.

However, to produce permanent magnets in each of the above-mentioned embodiments, the powders are subsequently compacted, preferably at a pressure of 0.5 to 12 T/cm$^2$. Nevertheless, the pressure for compaction is not critical. The compaction is performed in a magnetic field to produce anisotropic permanent magnets. Preferably, a magnetic field of about 7 to 15 kOe is applied in order to align the particles. Moreover, a magnetic field is not applied during compaction when producing isotropic permanent magnets. In either case, the compacted alloy material is sintered at a temperature of from about 900° C. to about 1200° C. and, preferably, 1000° C. to 1180° C. The sintered material is then heat treated at a temperature of from about 200° C. to about 1050° C.

In another embodiment, the process for producing a permanent magnet in accordance with the present invention comprises:

a) crushing a rare earth-containing alloy in water to a particle size of from about 0.05 microns to about 100 microns, said alloy comprising, in atomic percent of the overall composition, of from about 12% to about 24% of at least one rare earth element, selected from the group consisting of neodymium, praseodymium, lanthanum, cerium, terbium, dysprosium, holmium, erbium, europium, samarium, gadolinium, promethium, thulium, ytterbium, lutetium, yttrium, and scandium, from about 2% to about 28% boron and the balance iron;

b) compacting the crushed alloy material;

c) drying the compacted alloy material at a temperature below the phase transformation temperature of the material;

d) treating the compacted alloy material with a passivating gas for about 1 minute to about 60 minutes at a temperature from about 20° C. to about 580° C.;

e) sintering the compacted alloy material at a temperature of from about 900° C. to about 1200° C.; and f) heat treating the sintered material at a temperature from about 200° C. to about 1050° C.

The crushing, compacting, drying and treating steps (steps a through d) are the same as disclosed above for producing compacts. However, the compacted alloy material is thereafter sintered and heat treated to produce permanent magnets.

When nitrogen is used as the passivating gas to treat the alloy material, the resultant permanent magnet will have a nitrogen surface concentration of from about 0.4 to about 26.8 atomic percent and, preferably, 0.4 to 10.8 atomic percent. When carbon dioxide is used as the passivating gas, the resultant permanent magnet will have a carbon surface concentration of from about 0.02 to about 15 atomic percent and, preferably, from 0.5 to 6.5 atomic percent. Of course, if a combination of nitrogen and carbon dioxide is used, the surface concentrations of the respective elements will be within the above-stated ranges.

Another preferred embodiment of the present invention includes an improved permanent magnet of the type comprised of, in atomic percent of the overall composition, from about 12% to about 24% of at least one rare earth element selected from the group consisting of neodymium, praseodymium, lanthanum, cerium, terbium, dysprosium, holmium, erbium, europium, samarium, gadolinium, promethium, thulium, ytterbium, lutetium, yttrium, and scandium, from about 2% to about 28% boron and at least 52% iron, wherein the improvement comprises a nitrogen surface concentration of from about 0.4 to about 26.8 atomic percent and, preferably, from 0.4 to 10.8 atomic percent. The preferred rare earth element is neodymium and/or praseodymium. A further preferred embodiment is an improved permanent magnet of the type comprised of, in atomic percent of the overall composition, from about 12% to about 24% of at least one rare earth element selected from the group consisting of neodymium, praseodymium, lanthanum, cerium, terbium, dysprosium, holmium, erbium, europium, samarium, gadolinium, promethium, thulium, ytterbium, lutetium, yttrium, and scandium, from about 2% to about 28% boron and at least 52% iron, wherein the improvement comprises a carbon surface concentration of from about 0.02 to about 15 atomic percent and, preferably, 0.5 to 6.5 atomic percent. The preferred rare earth element is also neodymium and/or praseodymium. The present invention is applicable to either anisotropic or isotropic permanent magnet materials, although isotropic materials have lower magnetic properties compared with the anisotropic materials.

The permanent magnets in accordance with the present invention have a high resistance to corrosion, highly developed magnetic and crystallographic texture, and high magnetic properties (coercive force, residual induction, and maximum energy product). In order to more clearly illustrate this invention, the examples set forth below are presented. The following examples are included as being illustrations of the invention and should not be construed as limiting the scope thereof.

EXAMPLES

Alloys were made by induction melting a mixture of substantially pure commercially available forms of elements to produce the following composition in weight percent: Nd—35.2%, B—1.2%, Dy—0.2%, Pr—0.4%, Mn—0.1%, Al—0.1% and Fe—balance. Powders and permanent magnets were then prepared from this base composition in accordance with the present invention. The alloys were crushed in distilled water, dried in vacuum and treated with a passivating gas.

FIGS. 1-11 illustrate the distribution of particle size and shape of powder for various weight ratios between powder and milling balls ($P_a/P_b$) and grinding times. The powder samples were oriented in a magnetic field and measurements were made on a plane perpendicular to the magnetic field. FIGS. 1-11 show that the particle size and shape of powder produced in accordance with the present invention were optimized for compacting of the powder in a magnetic field to produce magnets since the number of desired rectangular shaped particles was maximized.

Figure 12:
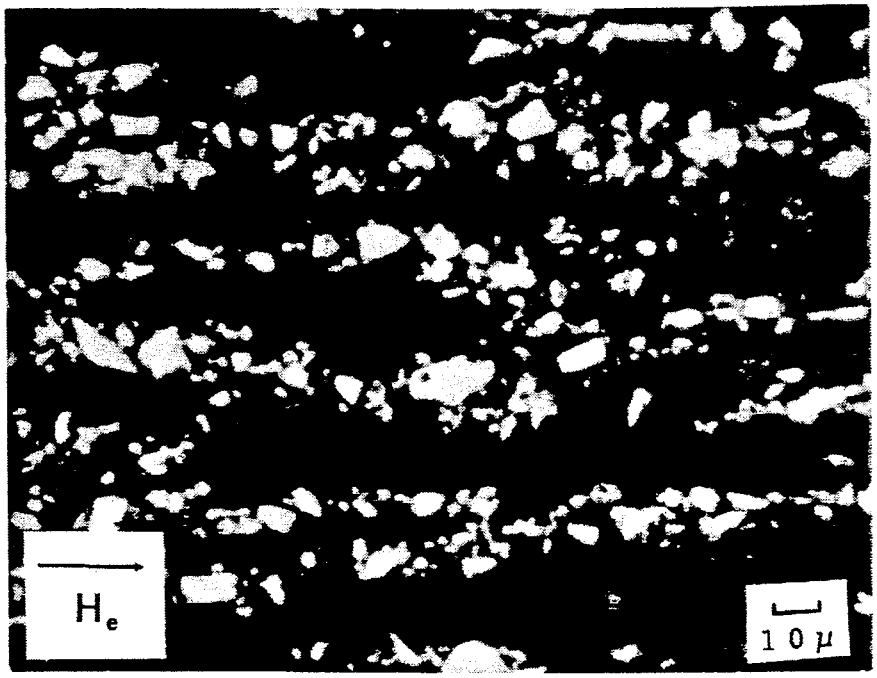
FIG. 12 is a photomicrograph at 650× magnification of Nd-Fe-B powder produced in accordance with the present invention and oriented in a magnetic field.
Figure 13:
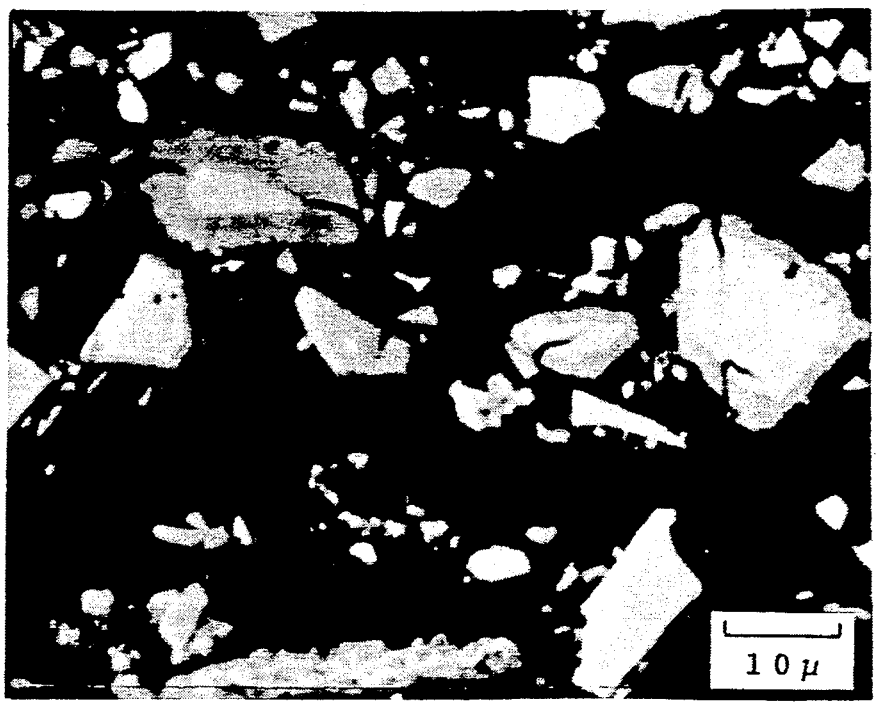
FIG. 13 is a photomicrograph at 1600X× magnification of Nd-Fe-B powder produced in accordance with the present invention.
Figure 14:
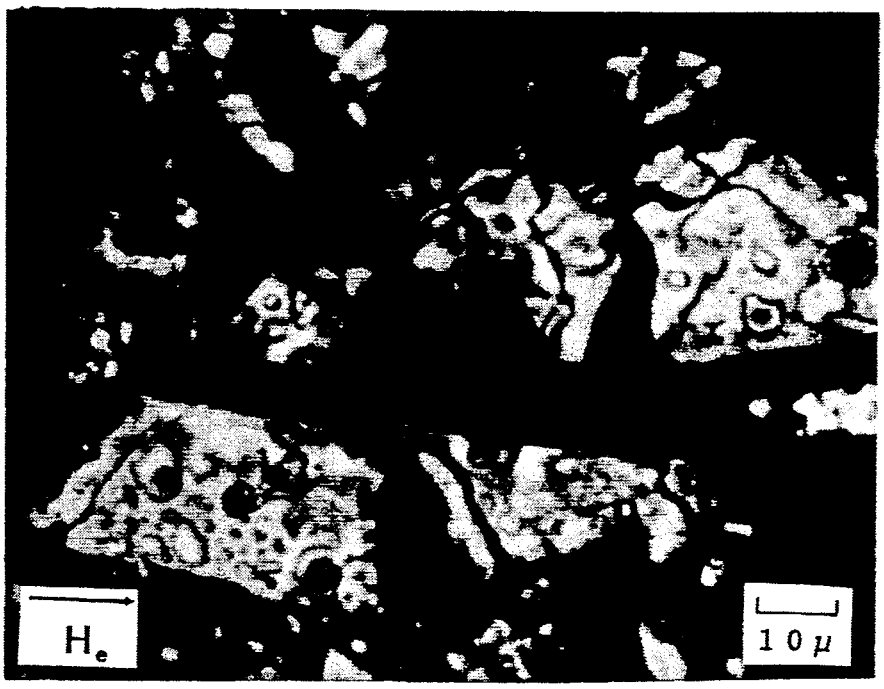
FIG. 14 is a photomicrograph at 1100X× magnification of Nd-Fe-B powder produced by conventional powder metallurgy technique and oriented in a magnetic field.

FIG. 12 illustrates a distribution of particle size and shape of Nd-Fe-B powder produced in accordance with the present invention and oriented in a magnetic field ($H_e$) as shown in the figure. FIG. 13 illustrates Nd-Fe-B powder produced in accordance with the present invention wherein the nitrogen containing surface layer is visible. FIG. 14 illustrates Nd-Fe-B B powder produced by conventional powder metallurgy technique with the powder crushed in hexane and oriented in a magnetic field ($H_e$) as shown in the figure. Corrosion is evident in the conventional powder illustrated in FIG. 14.

Figure 15:
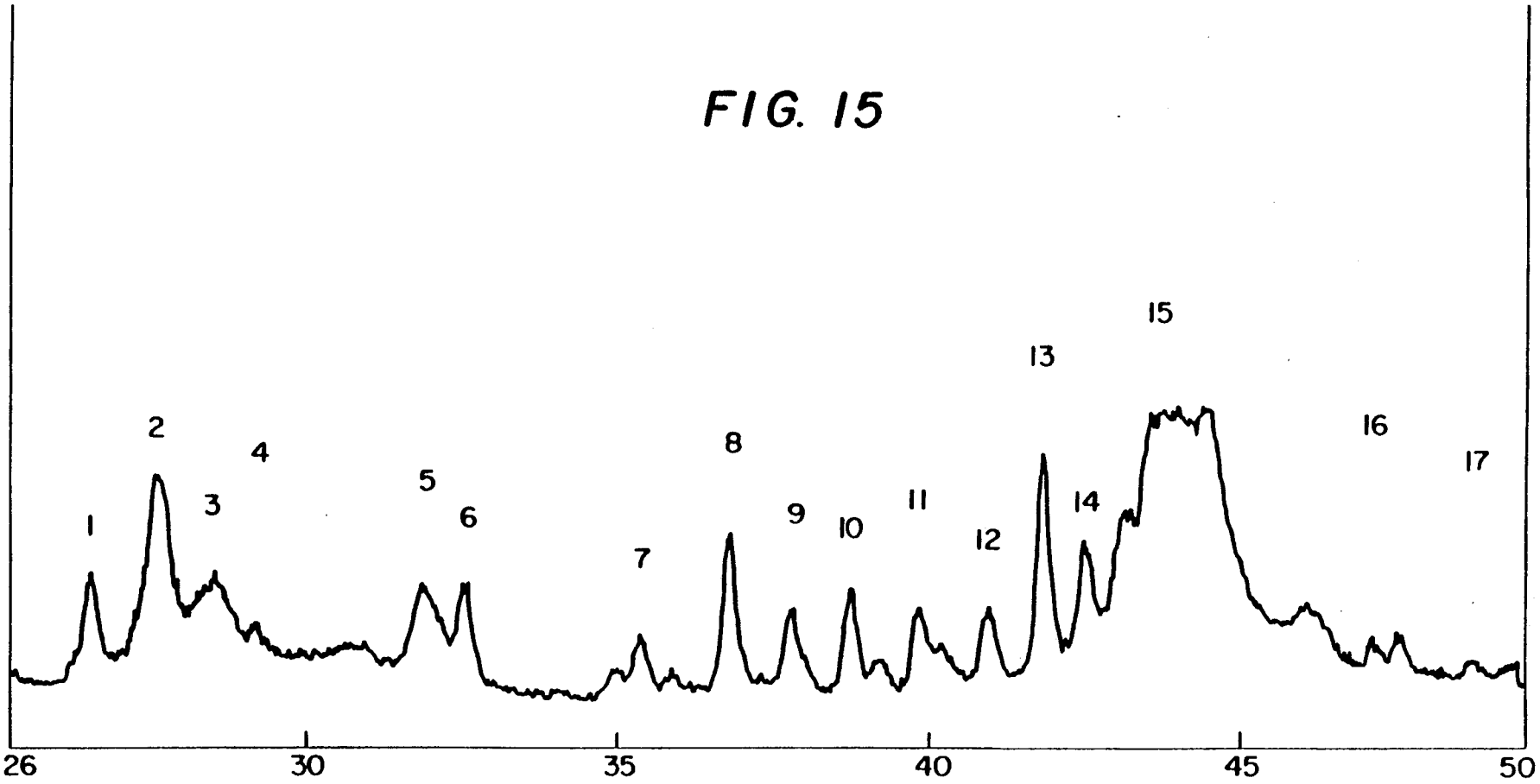
FIG. 15 is an X-ray diffraction pattern of Nd-Fe-B powder produced in accordance with the present invention.
Figure 16:
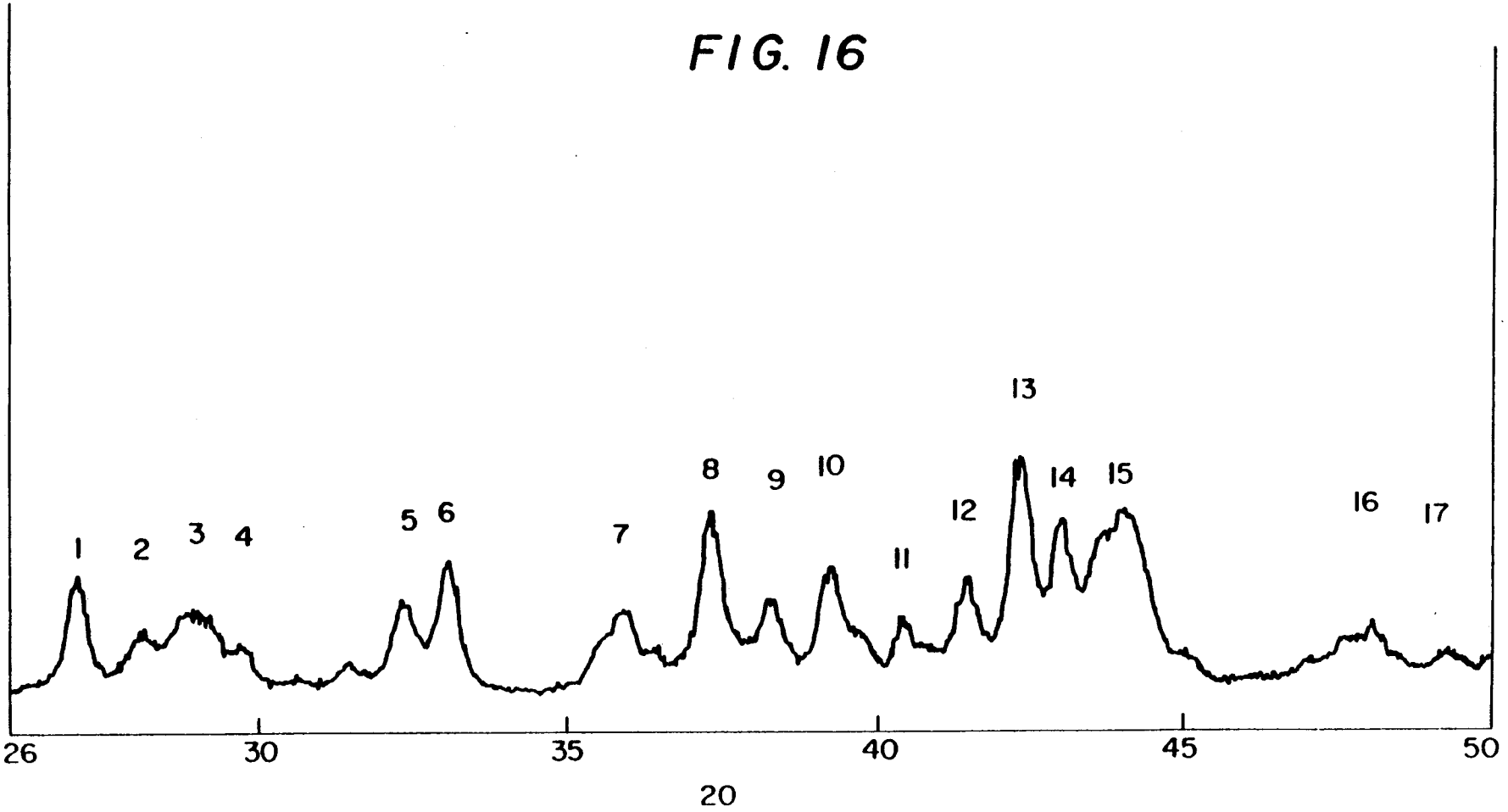
FIG. 16 is an X-ray diffraction pattern of Nd-Fe-B powder produced by conventional powder metallurgy technique.

FIG. 15 is an X-ray diffraction pattern of Nd-Fe-B powder produced in accordance with the present invention and FIG. 16 is an X-ray diffraction pattern of Nd-Fe-B powder produced by conventional powder metallurgy technique. Comparison of FIG. 15 and FIG. 16 illustrates the difference in peak widths which indicates a higher defect density of domain wall pinning sites in the individual particles of the present invention. Comparison of FIG. 15 and FIG. 16 also illustrates the difference in peak widths which indicates a higher density of defects that nucleate domains in the individual particles of the conventional powder, which adversely affect magnetic properties.

Powders and permanent magnets were prepared from the above-mentioned base composition in accordance with the present invention and the experimental parameters, including: the weight ratio between powder and milling balls ($P_a/P_b$), the length of time (T) the alloys were crushed in minutes, the typical particle size range of the powder after crushing ($D_p$) in microns, and the temperature at which the powder was treated with the passivating gas ($T_p$) in degrees centigrade, are given below in Table I. Nitrogen was used as the passivating gas for Samples 1, 4, 7 and 10. Carbon dioxide was used as the passivating gas for Samples 2, 5, 8, and 11. A combination of nitrogen and carbon dioxide was used as the passivating gas for Samples 3, 6, 9 and 12. Sample 13 is a prior art sample made by conventional methods for comparison. FIG. 14 is a photomicrograph of Sample 13 and FIG. 16 is an X-ray diffraction pattern of Sample 13. Each powder sample was compacted, sintered and heat treated. Magnetic properties were measured, and residual induction and maximum energy product were corrected for 100% density. The magnetic properties included magnetic texture (A %-calculated), average grain size in the sintered magnet ($D_g$), intrinsic coercive force $H_{ci}$(kOe), coercive force $H_c$(kOe), residual induction $B_r$(kG), maximum energy product $(BH)_{max}$(MGOe), and corrosion activity. The corrosion activity was measured visually after the samples had been exposed to 100% relative humidity for about two weeks (N—no corrosion observed, A—full corrosive activity observed, and S—slight corrosive activity observed). These results are also reported in Table I below.

TABLE I

| Sample Number | $P_a/P_b$ | T (min) | $D_p$ (μm) | $T_p$ (°C.) | Surface Concentration (Atomic %) N | C | A (%) | $D_g$ (μm) | $H_{ci}$ (kOe) | $H_c$ (kOe) | $B_r$ (kG) | $(BH)_{max}$ (MGOe) | Corrosion Activity |
|---|---|---|---|---|---|---|---|---|---|---|---|---|---|
| 1 | 1:24 | 30 | 0.5-5 | 90 | 1.0 | — | 98.42 | 12.0 | 12.51 | 10.92 | 11.21 | 31.68 | N |
| 2 | " | " | " | 115 | — | 1.0 | 98.64 | 10.5 | 11.21 | 10.21 | 12.11 | 32.79 | N |
| 3 | " | " | " | 125 | 1.0 | 1.0 | 97.54 | 13.5 | 10.28 | 9.68 | 10.41 | 31.18 | N |
| 4 | " | " | " | 155 | 5.0 | — | 98.85 | 10.6 | 10.82 | 10.75 | 11.41 | 32.92 | N |
| 5 | " | " | " | 150 | — | 5.0 | 99.36 | 9.6 | 11.69 | 11.02 | 12.81 | 34.58 | N |
| 6 | " | " | " | 175 | 5.0 | 5.0 | 99.16 | 10.1 | 11.85 | 11.01 | 12.57 | 34.83 | N |
| 7 | " | " | " | 175 | 7.6 | — | 99.49 | 8.4 | 11.94 | 11.58 | 13.14 | 37.26 | N |
| 8 | " | " | " | 195 | — | 5.1 | 99.21 | 11.0 | 11.68 | 10.69 | 12.32 | 34.91 | N |
| 9 | " | " | " | 195 | 7.6 | 5.1 | 99.68 | 9.2 | 13.24 | 11.82 | 12.62 | 35.62 | N |
| 10 | " | " | " | 300 | 22.5 | — | 94.92 | 16.8 | 6.54 | 4.64 | 5.82 | 2.83 | S |
| 11 | " | " | " | 340 | — | 6.5 | 97.92 | 10.8 | 10.41 | 9.49 | 9.86 | 20.45 | N |
| 12 | " | " | " | 340 | 10.8 | 6.5 | 94.86 | 15.8 | 5.19 | 5.06 | 6.24 | 5.92 | S |
| 13 | 1:9 | 45 | 7-15 | — | — | — | 98.32 | 13.7 | 13.02 | 10.22 | 10.95 | 27.92 | A |

Figure 17:
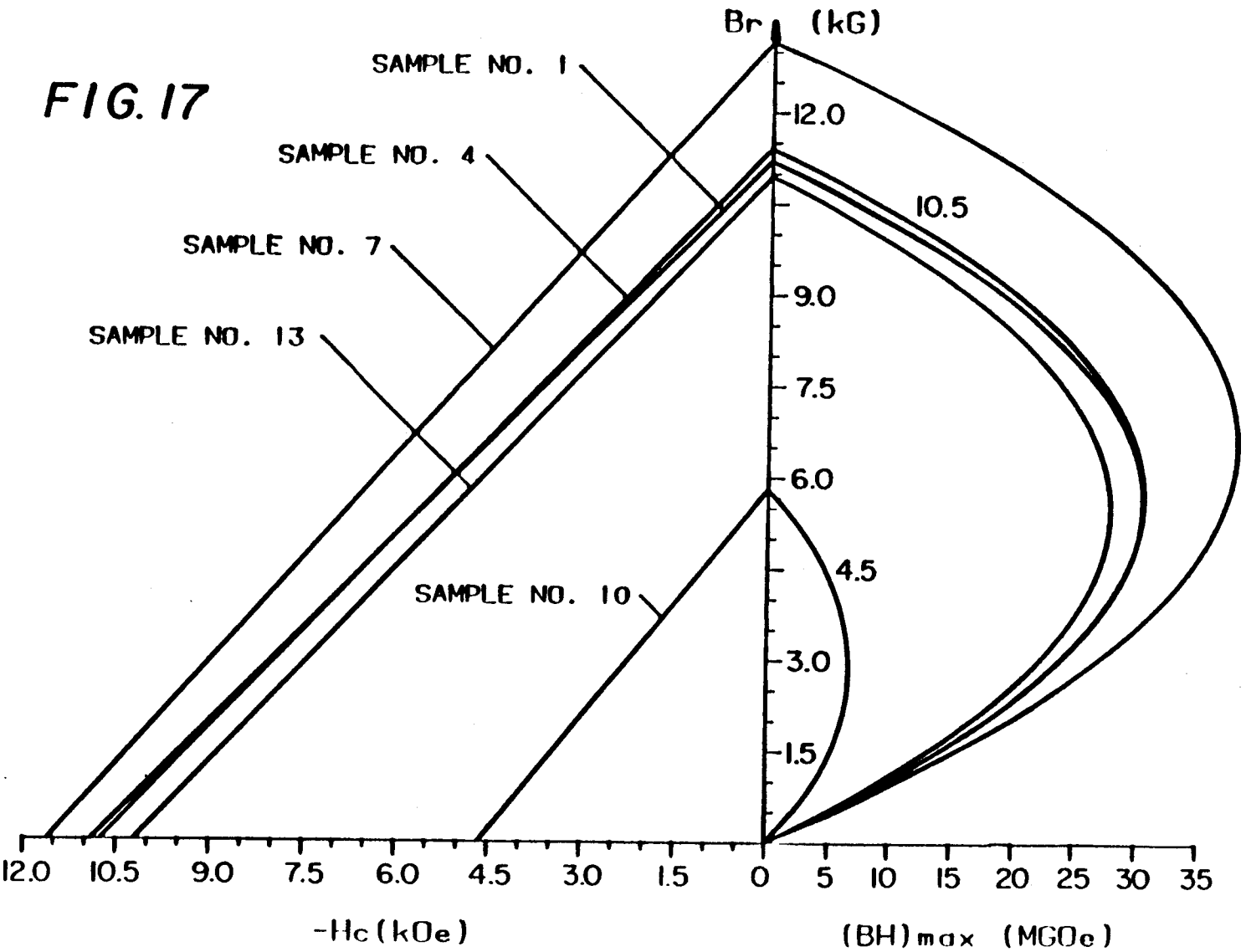
FIG. 17 is a graph showing the relationship between residual induction $B_r$(kG) on the vertical axis and coercive force $H_c$(kOe) as well as maximum energy product $(BH)_{max}$ (MGOe) on the horizontal axis and comparing a conventional Nd-Fe-B magnet with examples having nitrogen surface concentrations in accordance with the present invention.
Figure 18:
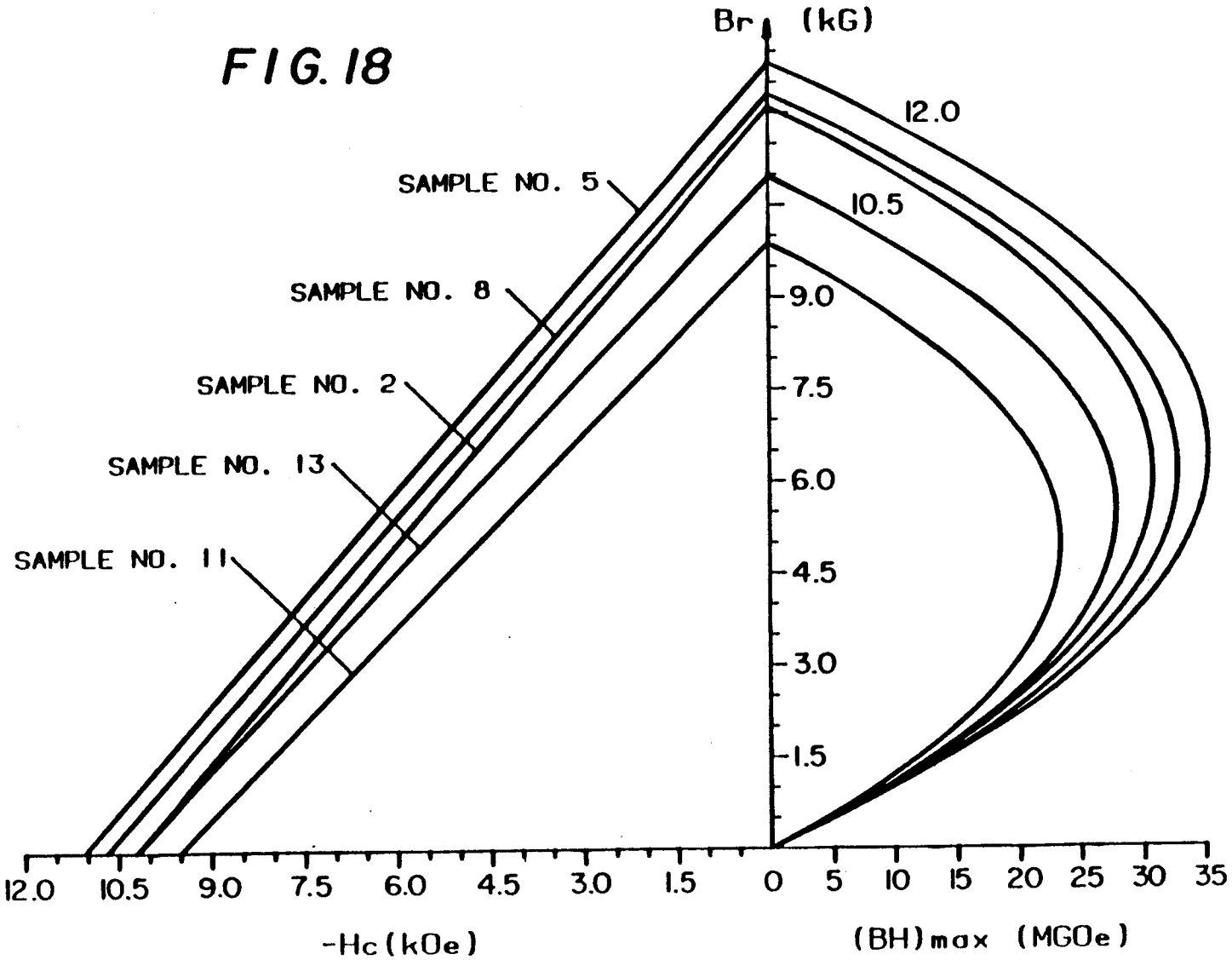
FIG. 18 is a graph showing the relationship between residual induction $B_r$(kG) on the vertical axis and coercive force $H_c$(kOe) as well as maximum energy product $(BH)_{max}$ (MGOe) on the horizontal axis and comparing a conventional Nd-Fe-B magnet with examples having carbon surface concentrations in accordance with the present invention.
Figure 19:
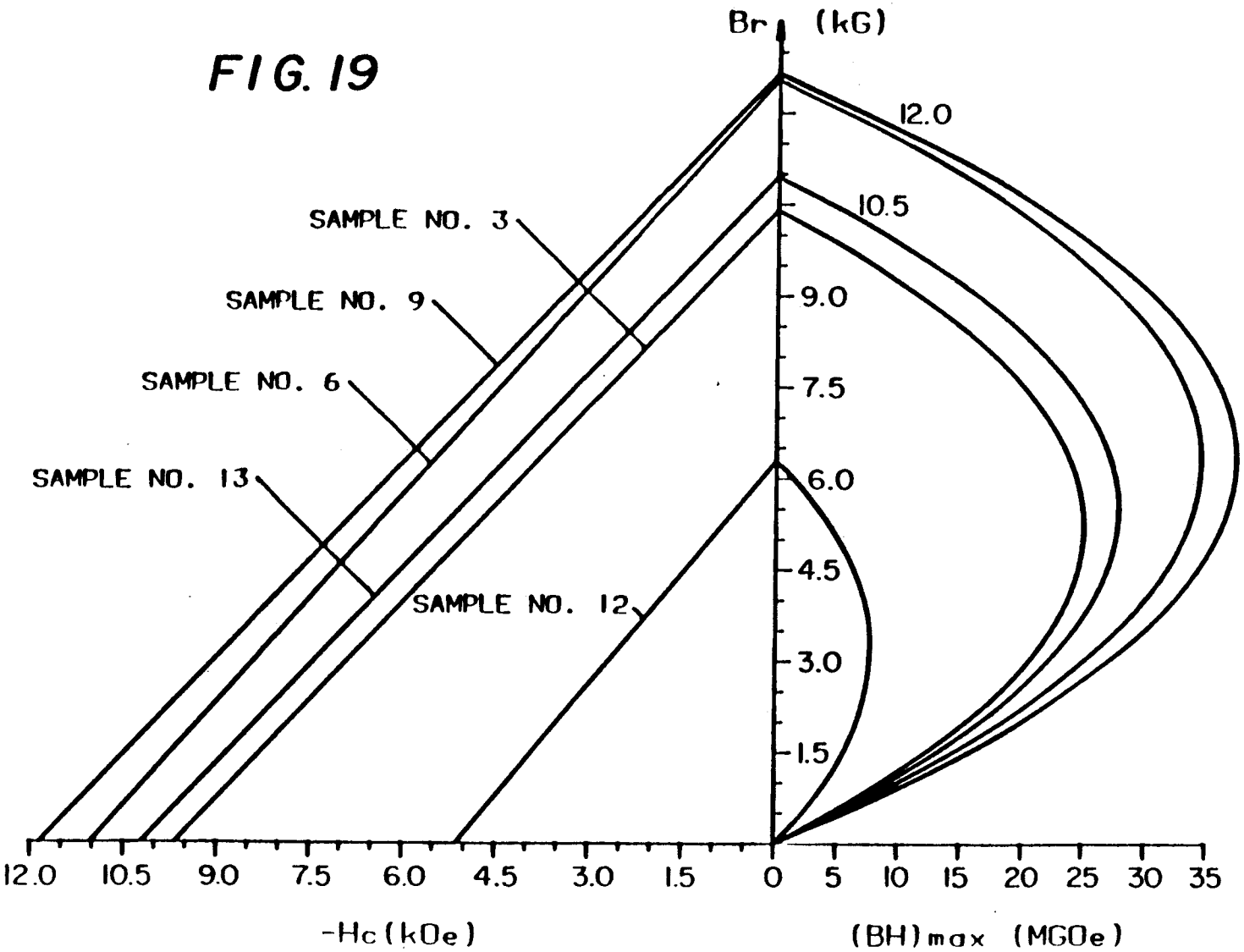
FIG. 19 is a graph showing the relationship between residual induction $B_r$(kG) on the vertical axis and coercive force $H_c$(kOe) as well as maximum energy product $(BH)_{max}$ (MGOe) on the horizontal axis and comparing a conventional Nd-Fe-B magnet With examples having nitrogen and carbon surface concentrations in accordance with the present invention.
Figure 20:
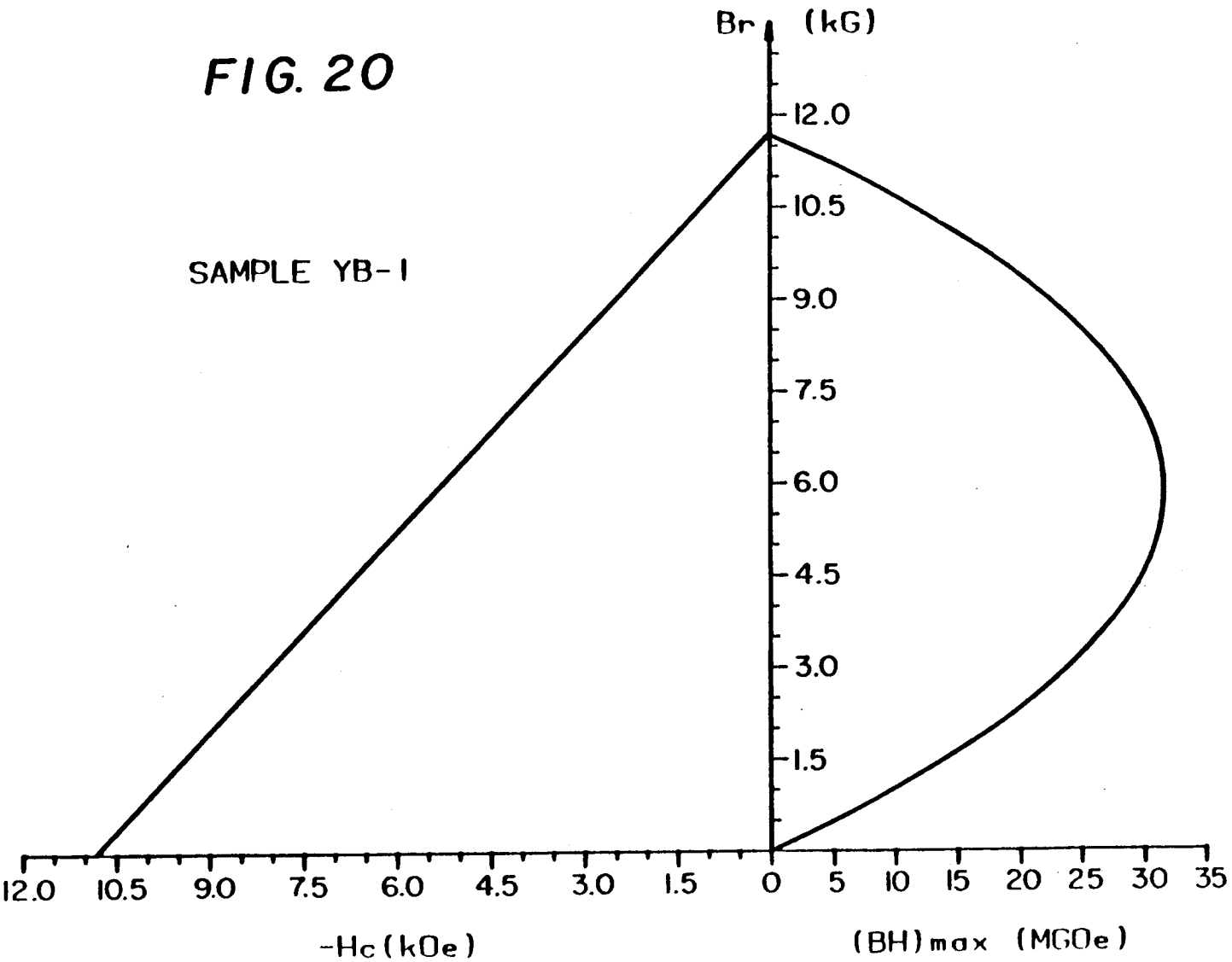
FIG. 20 is a graph showing the relationship between residual induction $B_r$(kG) on the vertical axis and coercive force $H_c$(kOe) as well as maximum energy product $(BH)_{max}$ (MGOe) on the horizontal axis for an example having nitrogen surface concentration in accordance with the present invention.
Figure 21:
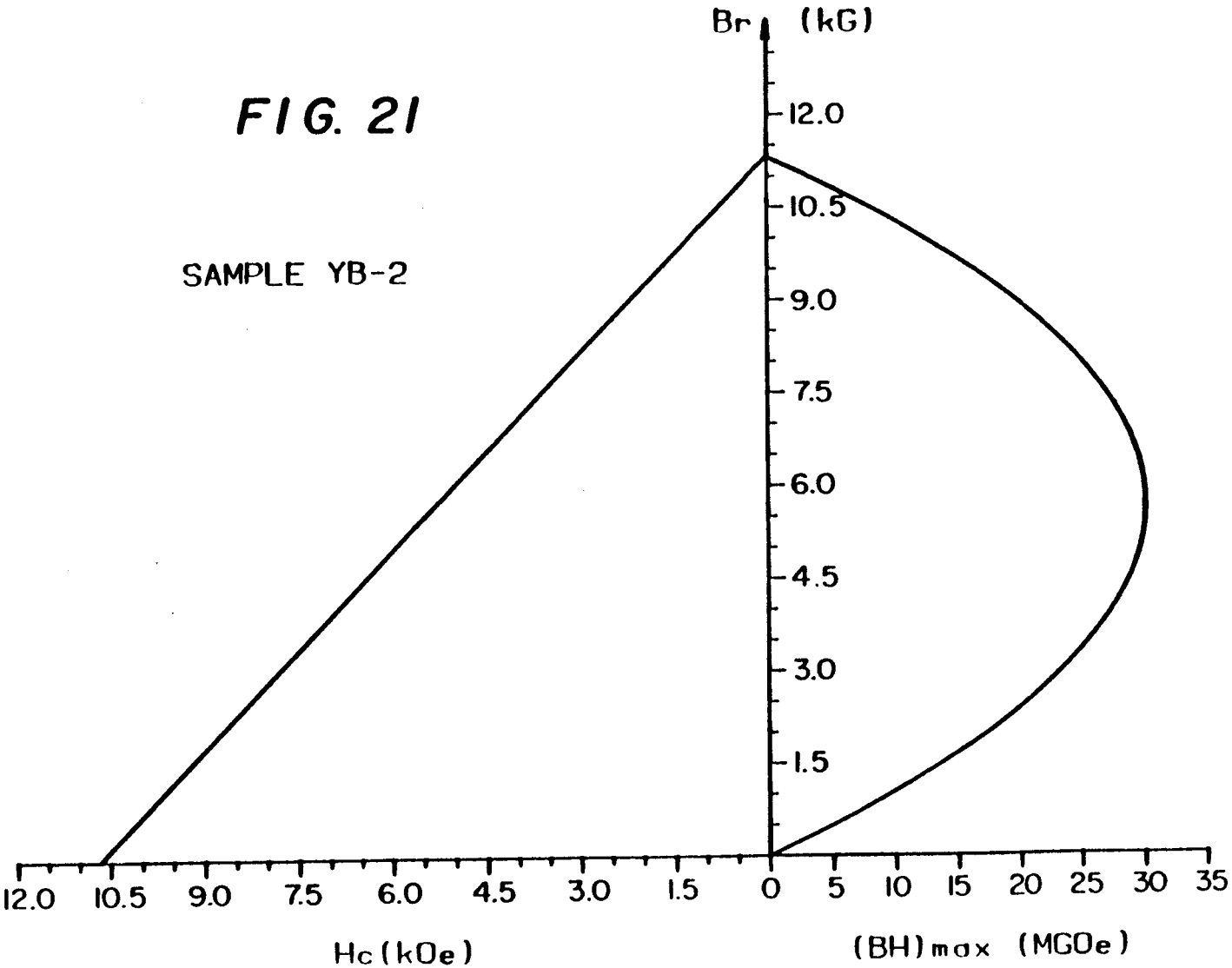
FIG. 21 is a graph showing the relationship between residual induction $B_r$(kG) on the vertical axis and coercive force $H_c$(kOe) as well as maximum energy product $(BH)_{max}$ (MGOe) on the horizontal axis for an example having nitrogen surface concentration in accordance with the present invention.
Figure 22:
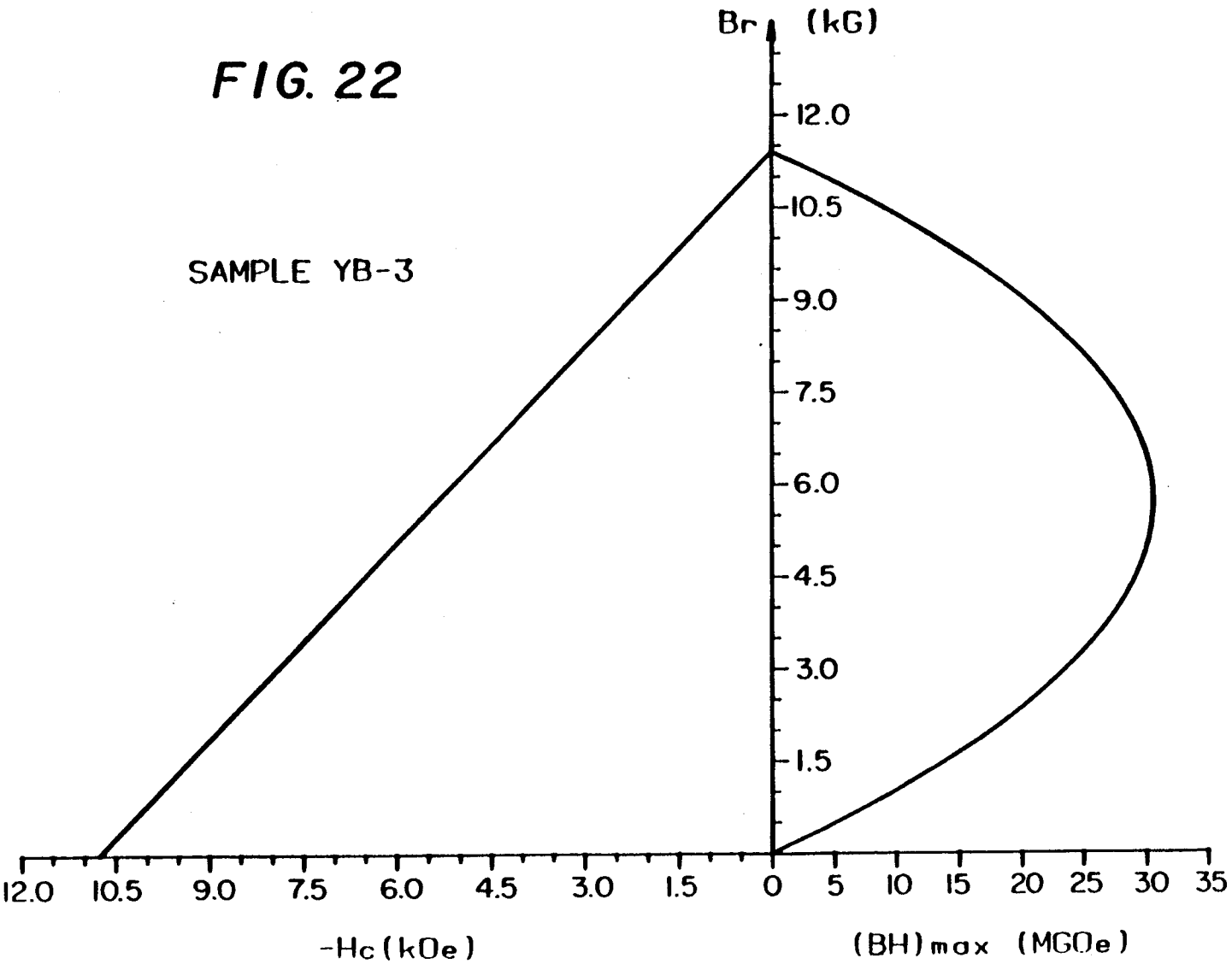
FIG. 22 is a graph showing the relationship between residual induction $B_r$(kG) on the vertical axis and coercive force $H_c$(kOe) as well as maximum energy product $(BH)_{max}$ (MGOe) on the horizontal axis for an example having nitrogen surface concentration in accordance with the present invention.
Figure 23:
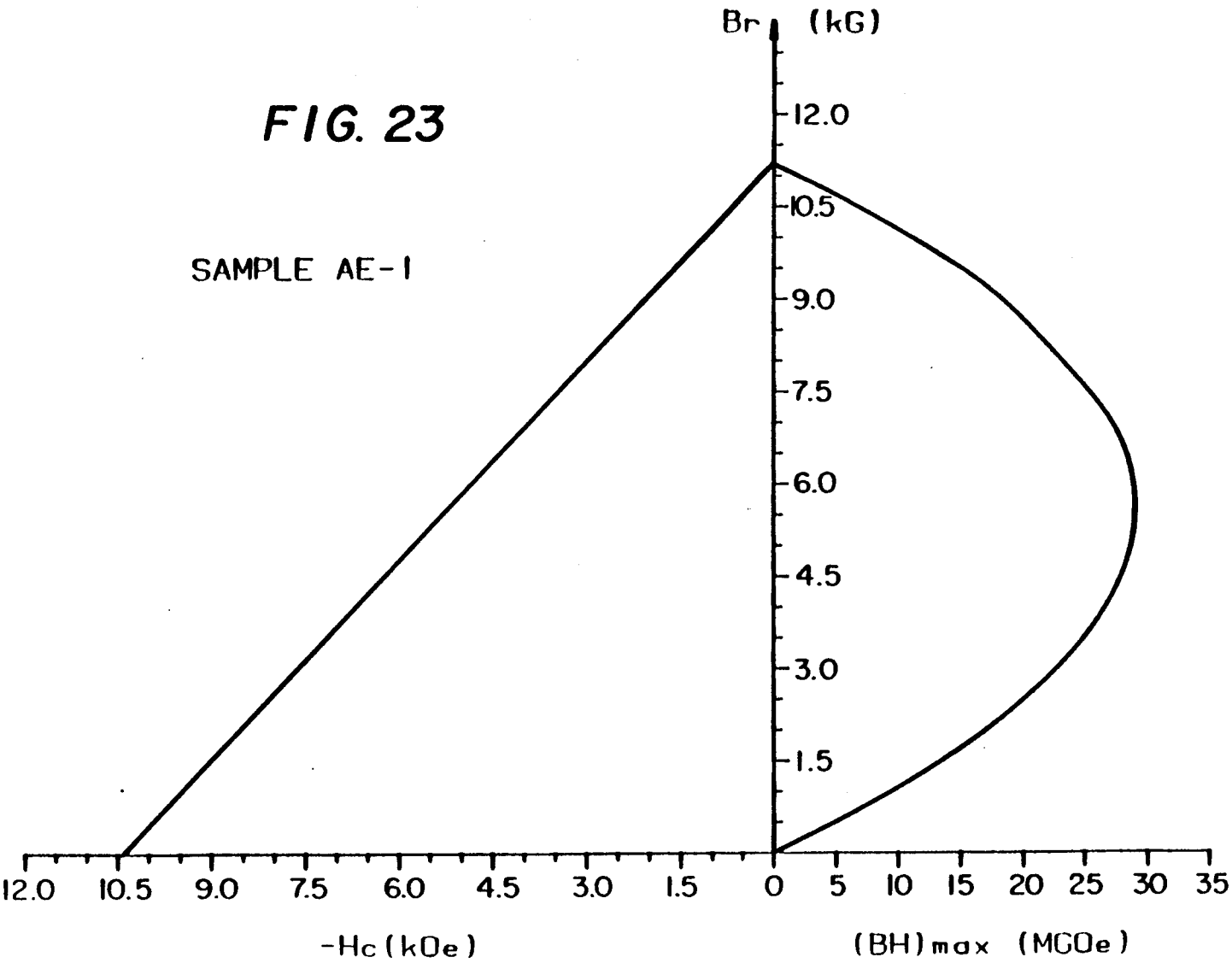
FIG. 23 is a graph showing the relationship between residual induction $B_r$(kG) on the vertical axis and coercive force $H_c$(kOe) as well as maximum energy product $(BH)_{max}$ (MGOe) on the horizontal axis for a conventional Nd-Fe-B magnet example.
Figure 24:
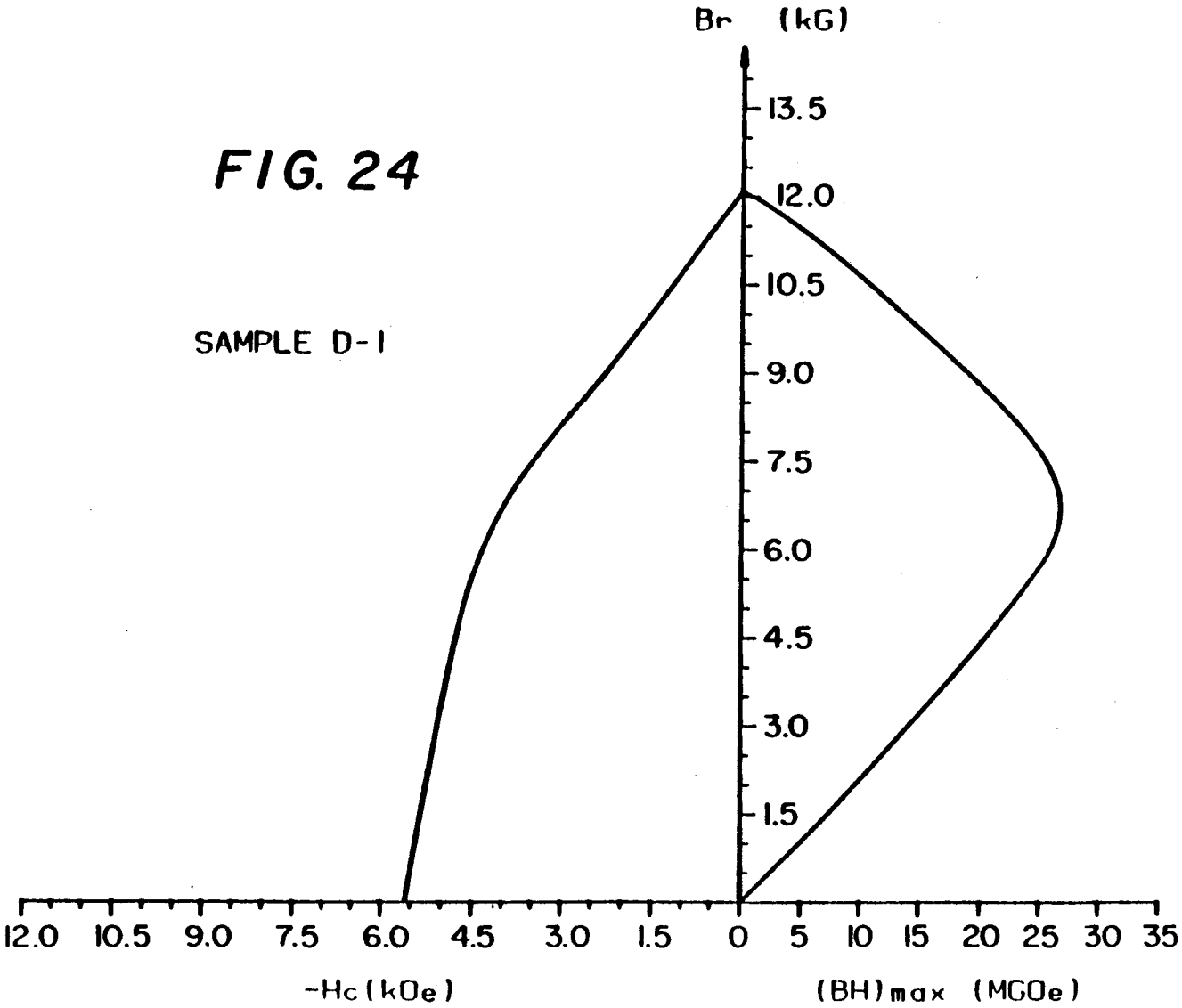
FIG. 24 is a graph showing the relationship between residual induction $B_r$(kG) on the vertical axis and coercive force $H_c$(kOe) as well as maximum energy product $(BH)_{max}$ (MGOe) on the horizontal axis for a sintered magnet example having carbon surface concentration in accordance with the present invention.
Figure 25:
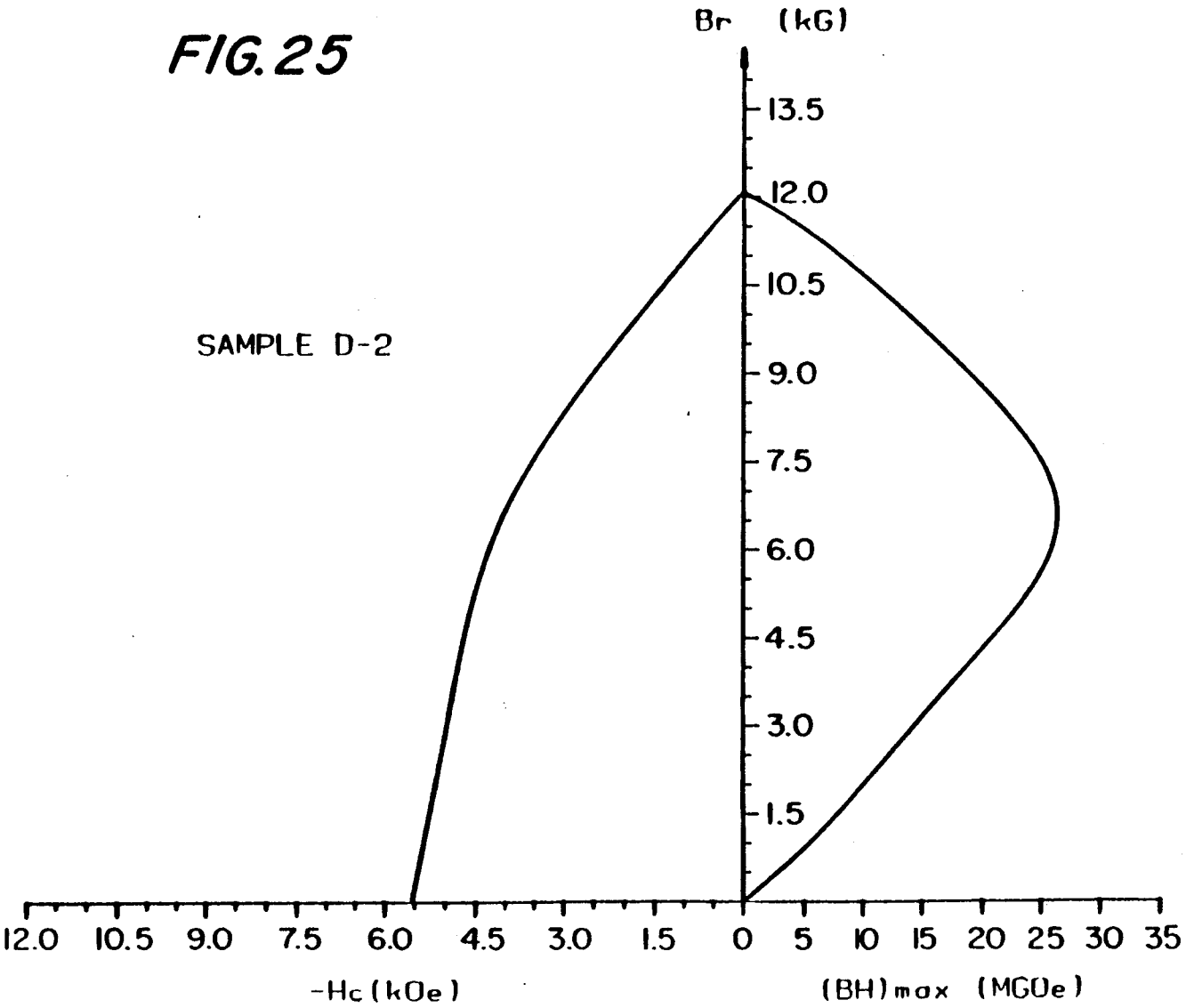
FIG. 25 is a graph showing the relationship between residual induction $B_r$(kG) on the vertical axis and coercive force $H_c$(kOe) as well as maximum energy product $(BH)_{max}$ (MGOe) on the horizontal axis for a sintered magnet example having carbon surface concentration in accordance with the present invention.
Figure 26:
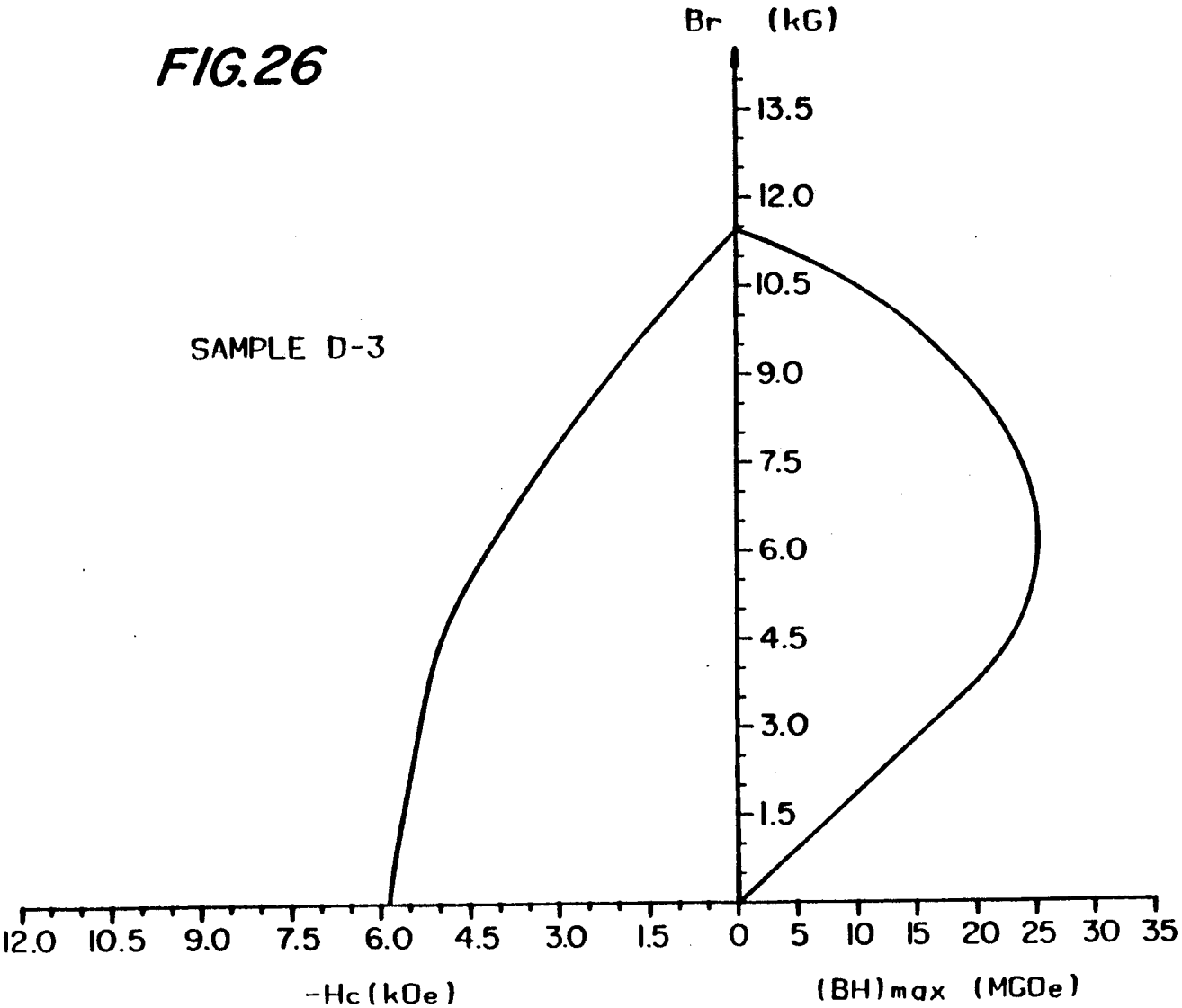
FIG. 26 is a graph showing the relationship between residual induction $B_r$(kG) on the vertical axis and coercive force $H_c$(kOe) as well as maximum energy product $(BH)_{max}$ (MGOe) on the horizontal axis for a sintered magnet example having carbon surface concentration in accordance with the present invention.
Figure 27:
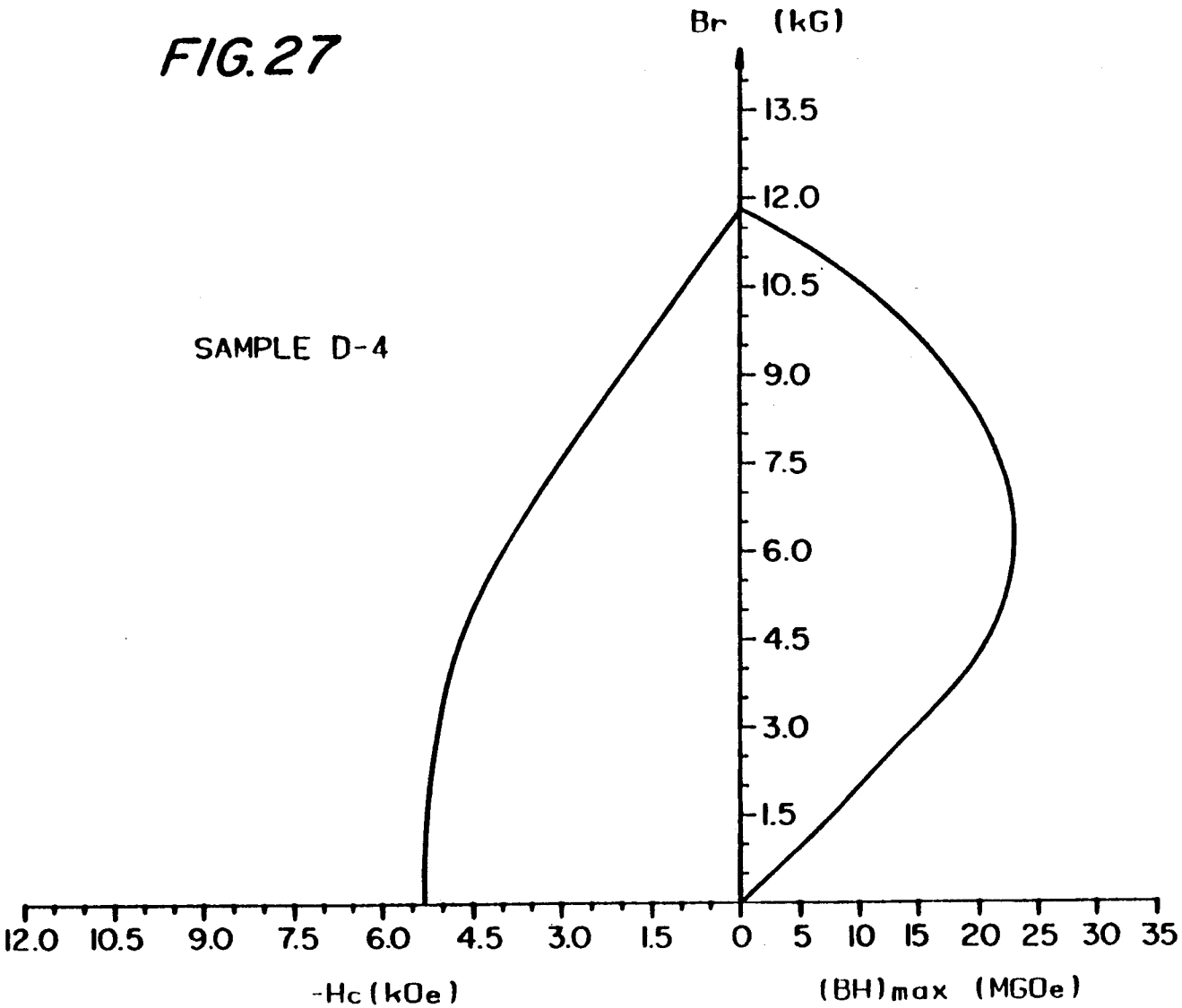
FIG. 27 is a graph showing the relationship between residual induction $B_r$(kG) on the vertical axis and coercive force $H_c$(kOe) as well as maximum energy product $(BH)_{max}$ (MGOe) on the horizontal axis for a sintered magnet example having nitrogen surface concentration in accordance with the present invention.
Figure 28:
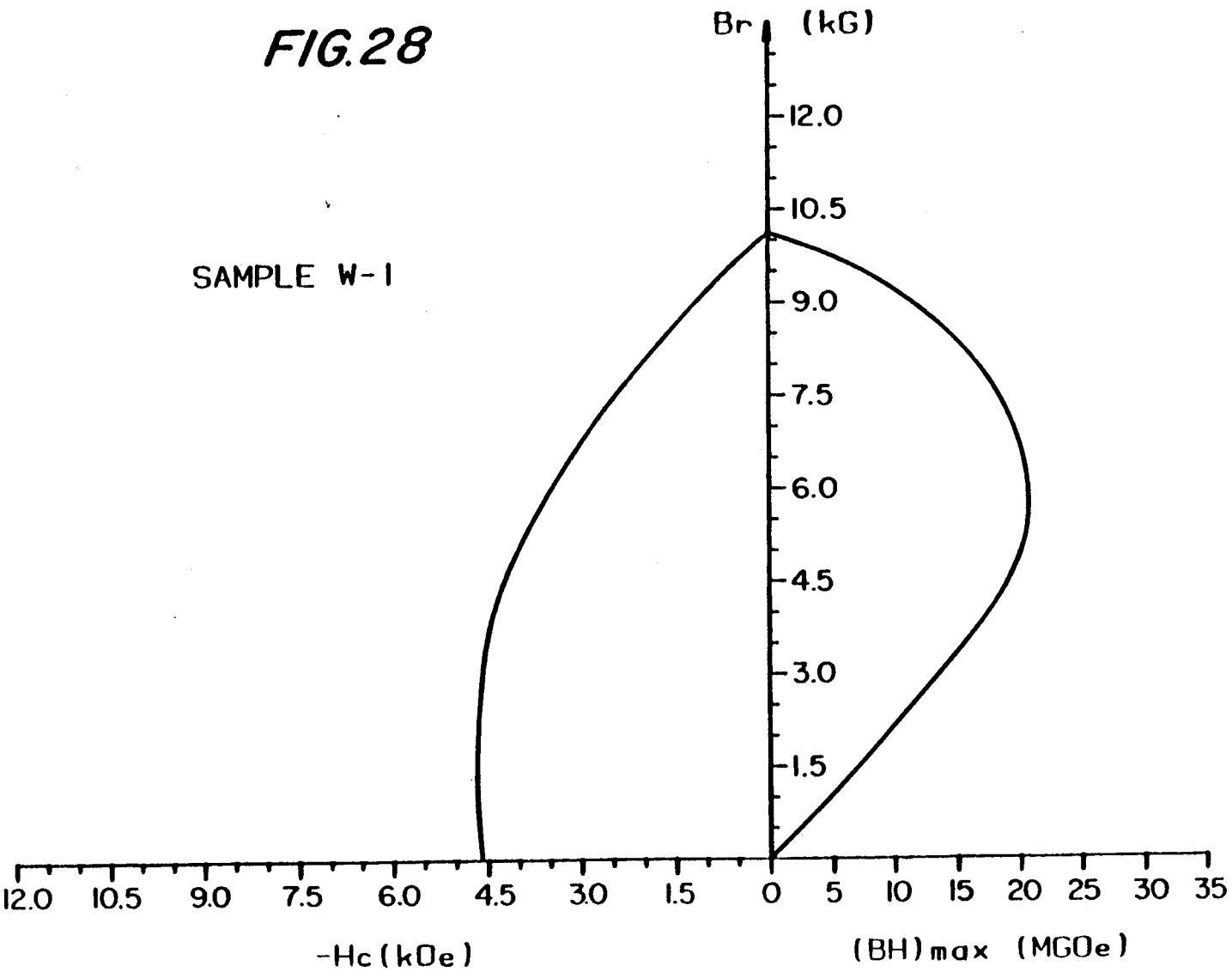
FIG. 28 is a graph showing the relationship between residual induction $B_r$(kG) on the vertical axis and coercive force $H_c$(kOe) as well as maximum energy product $(BH)_{max}$ (MGOe) on the horizontal axis for a sintered compact example having carbon surface concentration in accordance with the present invention.
Figure 29:
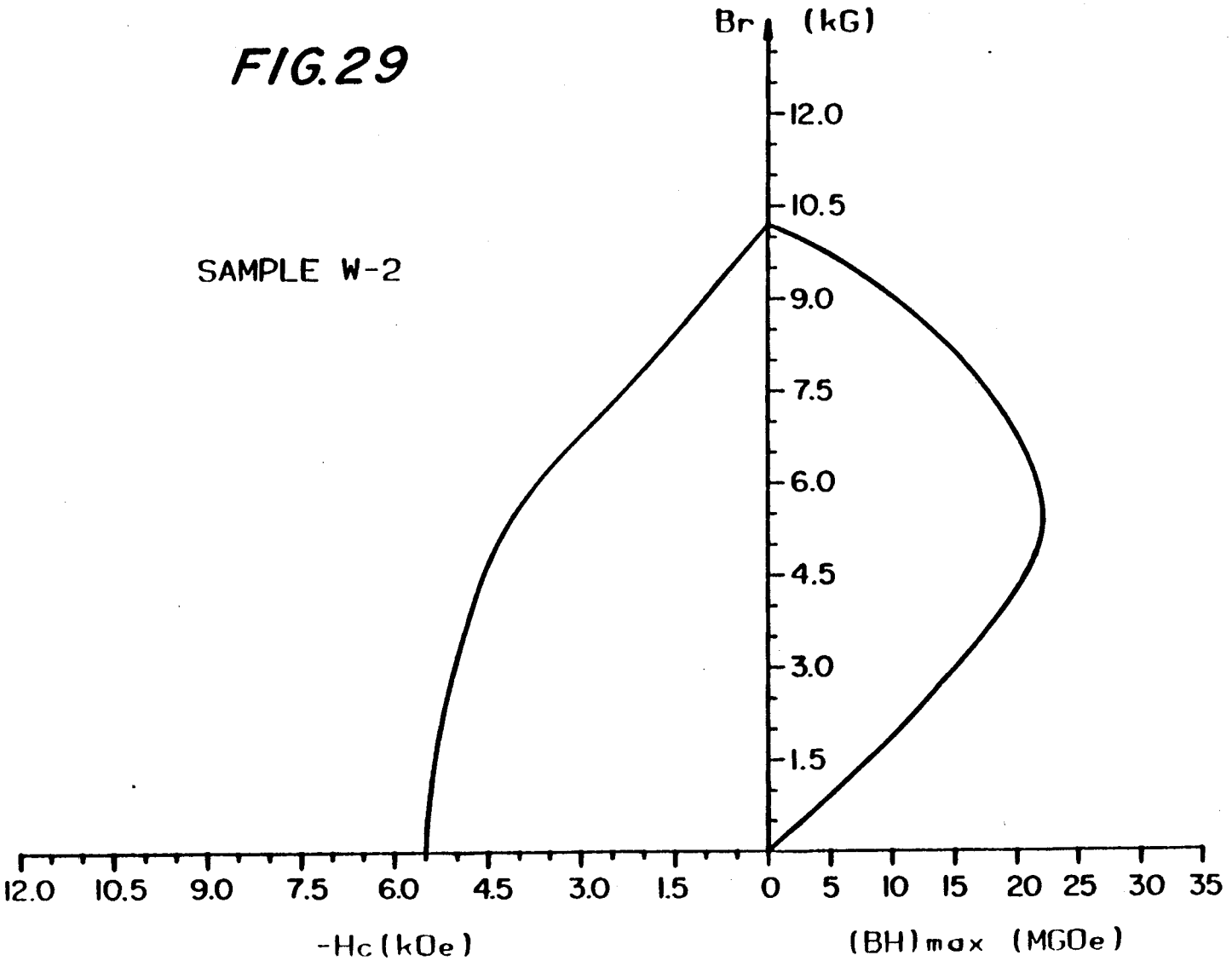
FIG. 29 is a graph showing the relationship between residual induction $B_r$(kG) on the vertical axis and coercive force $H_c$(kOe) as well as maximum energy product $(BH)_{max}$ (MGOe) on the horizontal axis for a sintered compact example having carbon and nitrogen surface concentration in accordance with the present invention.
Figure 30:
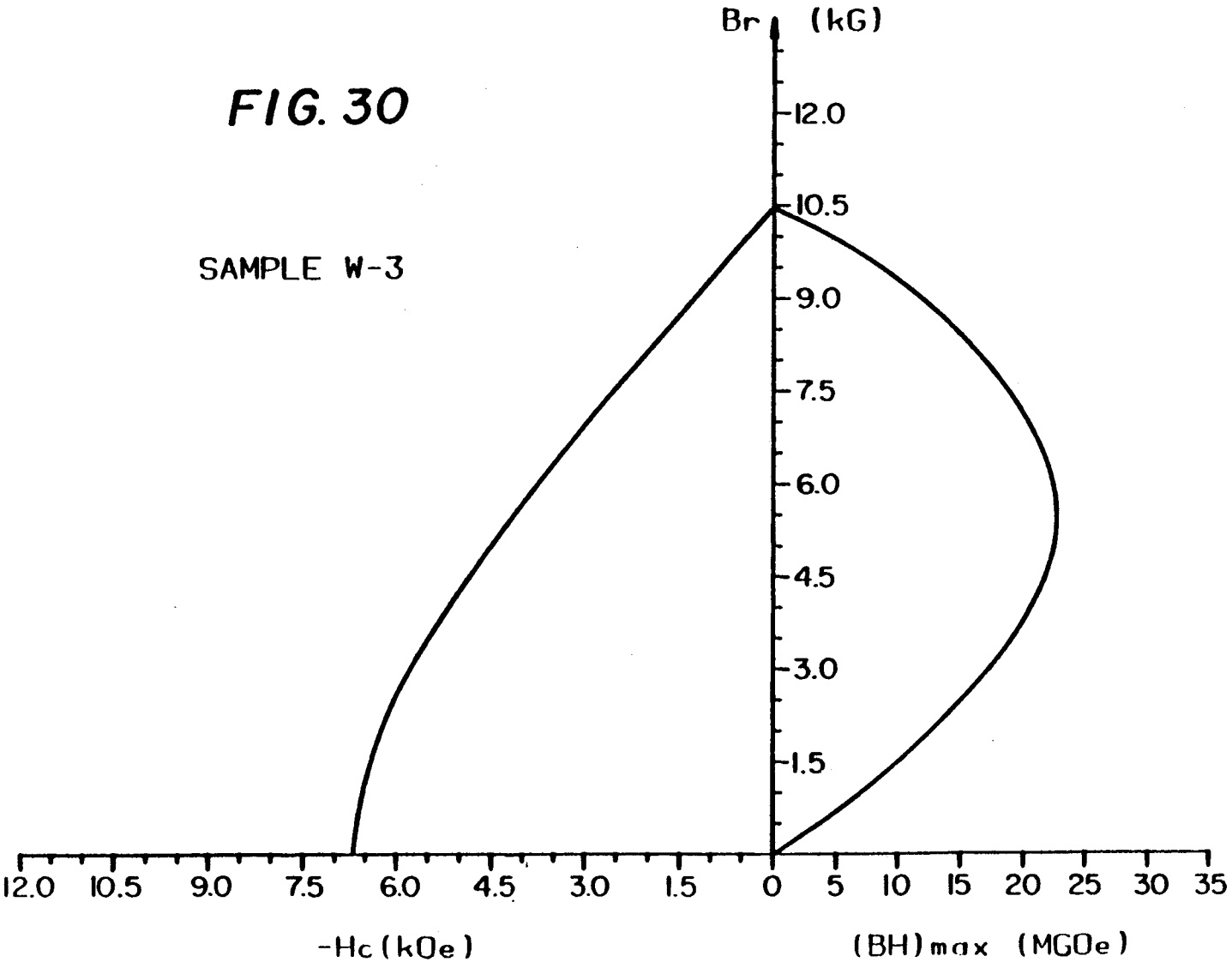
FIG. 30 is a graph showing the relationship between residual induction $B_r$(kG) on the vertical axis and coercive force $H_c$(kOe) as well as maximum energy product $(BH)_{max}$ (MGOe) on the horizontal axis for a sintered compact example having carbon surface concentration in accordance with the present invention.
Figure 31:
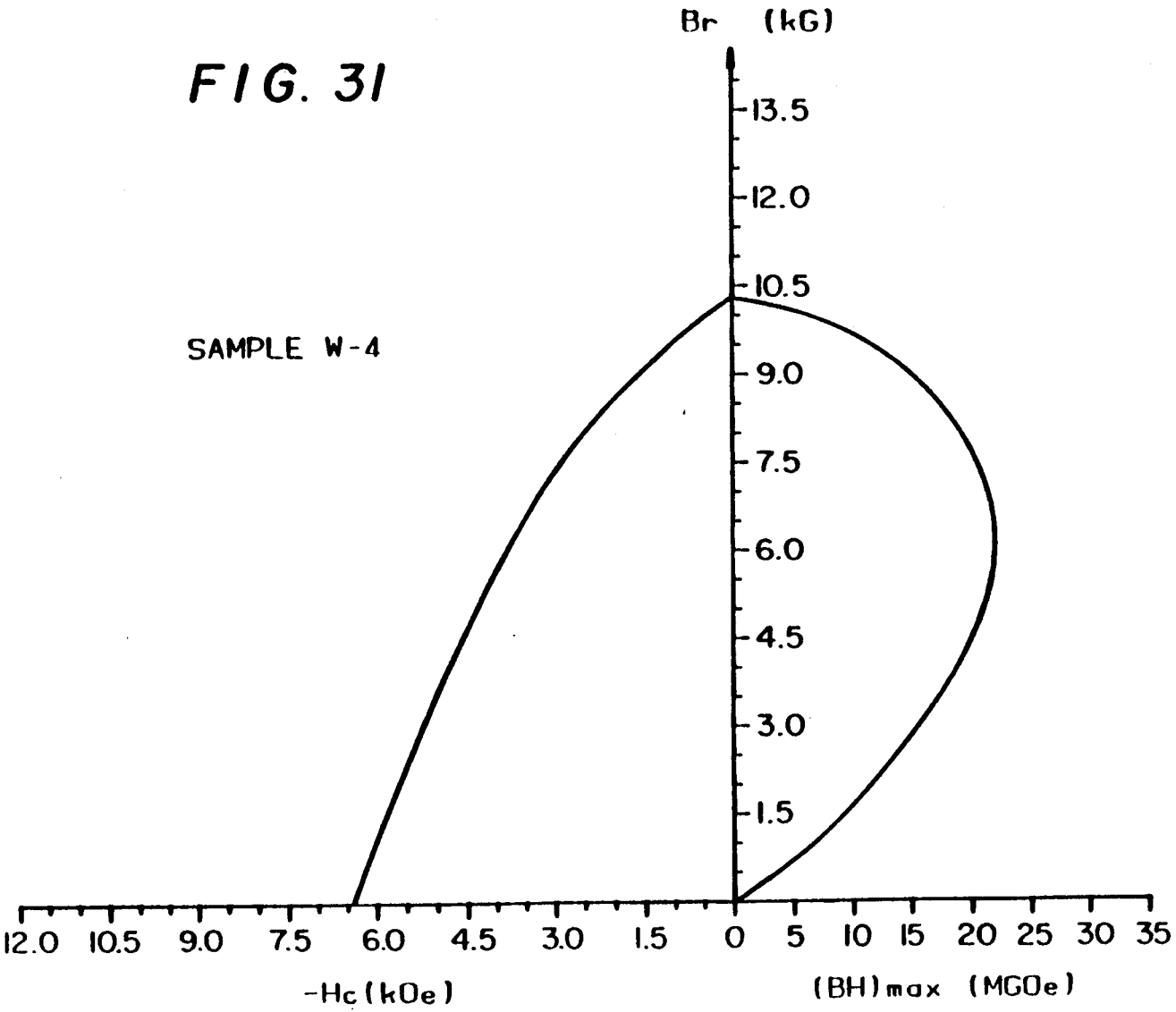
FIG. 31 is a graph showing the relationship between residual induction $B_r$(kG) on the vertical axis and coercive force $H_c$(kOe) as well as maximum energy product $(BH)_{max}$ (MGOe) on the horizontal axis for a sintered compact example having nitrogen surface concentration in accordance with the present invention.

As can be seen from the results reported in Table I, the improved permanent magnets produced in accordance with the present invention exhibit superior magnetic properties. These results are further illustrated in FIG. 17 which is a graph showing the relationship between residual induction $B_r$(kG) on the vertical axis and coercive force $H_c$(kOe) as well as maximum energy product $(BH)_{max}$(MGOe) on the horizontal axis for Samples 1, 4, 7 and 10 having nitrogen surface concentrations in accordance with the present invention, and prior art Sample 13. FIG. 18 illustrates the relationship between $B_r$(kG) on the vertical axis and $H_c$(kOe) as well as $(BH)_{max}$(MGOe) on the horizontal axis for Samples 2, 5, 8 and 11 having carbon surface concentrations in accordance with the present invention, and prior art Sample 13. FIG. 19 illustrates the relationship between $B_r$(kG) on the vertical axis and $H_c$(kOe) as well as $(BH)_{max}$(MGOe) on the horizontal axis for Samples 3, 6, 9 and 12 having both nitrogen and carbon surface concentrations in accordance with the present invention, and prior art Sample 13.

Permanent magnets were also made in accordance with this invention (Samples YB-1, YB-2 and YB-3) from powder having the following base composition in weight percent: Nd—35.77%, B—1.11%, Dy—0.57%. Pr—0.55% and Fe—balance. The powder utilized was passivated by a combination of 92% $N_2$ and 8% $CO_2$.

These samples were analyzed for nitrogen and carbon bulk content in weight % and surface concentration in atomic %. Magnetic properties and sintered density of the samples were measured. Sample AE-1 made by conventional powder metallurgy technique was also analyzed for comparative purposes. The results are reported in Table II below.

| SAMPLE NO. | YB-1 | YB-2 | YB-3 | AE-1 |
|---|---|---|---|---|
| Bulk Nitrogen (Weight %) | 0.0550 | 0.0539 | 0.0541 | 0.0464 |
| Bulk Carbon (Weight %) | 0.0756 | 0.0741 | 0.0760 | 0.0765 |
| Surface Nitrogen (Atomic %) | 1.5 | 1.5 | 1.5 | — |
| Surface Carbon (Atomic %) | * | * | * | — |
| $H_c$ (kOe) | 10.81 | 10.62 | 10.75 | 10.4 |
| $B_r$ (kG) | 11.59 | 11.31 | 11.37 | 11.2 |
| $H_{ci}$ (kOe) | 14.19 | 13.75 | 13.50 | 13.1 |
| $(BH)_{max}$ (MGOe) | 31.52 | 30.40 | 30.56 | 29.4 |
| Sintered Density (g/cm$^3$) | 7.52 | 7.53 | 7.51 | 7.29 |

*Below Level of Detection of AES

Magnetic property results for Samples YB-1, YB-2, YB-3 and AE-1 are further illustrated in FIGS. 20, 21, 22 and 23 respectively.

Additionally, sintered permanent magnets of the $Nd_2Fe_{14}B$ type were made in accordance with this invention (Samples D-1, D-2, D-3 and D-4) from alloy crushed in a passivating gas, the alloy having the following base composition in weight percent: Nd—35.4%, B—1.2% and Fe—balance. Sintered permanent magnets of the $SmCo_5$ type were also made in accordance with this invention (Samples D-5, D-6 and D-7) from alloy crushed in a passivating gas, the alloy having the following base composition in weight percent: Sm—37% and Co—balance. The alloy utilized was crushed in an attritor in a continuous flow of $CO_2$ for Samples D-1, D-2, D-3, D-5 and D-6, and $N_2$ for Samples D-4 and D-7, at a pressure of about 13.5 psig at ambient temperature to a particle size range of about 0.2 microns to 100 microns. The powder was removed from the attritor, compacted without a protective atmosphere, and then sintered. Samples D-5, D-6 and D-7 were also annealed at 900° C. for 1 hour. However, the magnetic properties of all the sintered magnet samples would be enhanced by additional heat treatment as can be appreciated by those skilled in the art. The density and magnetic properties were measured and the results are reported in Table III below and FIGS. 24–27.

TABLE III

| SAMPLE NO. | D-1 | D-2 | D-3 | D-4 | D-5 | D-6 | D-7 |
|---|---|---|---|---|---|---|---|
| Crushing Time (min) | 10 | 10 | 15 | 10 | 15 | 15 | 15 |
| $P_a/P_b$ | 1:10 | 1:10 | 1:10 | 1:10 | 1:10 | 1:10 | 1:10 |
| Passivating Gas | $CO_2$ | $CO_2$ | $CO_2$ | $N_2$ | $CO_2$ | $CO_2$ | $N_2$ |
| Time Delay Between Crushing and Compacting | None | 14 days | None | None | None | 3 days | 3 days |
| $D_p$ (μm) | ~6 | ~6 | ~6 | ~6 | ~1.5 | ~1.5 | ~1.5 |
| Pressure (T/cm$^2$) | 5.0 | 5.0 | 5.0 | 5.0 | 3.3 | 3.3 | 5.0 |
| Density (g/cm$^3$) | 7.27 | 7.25 | 7.36 | 7.24 | 8.34 | 8.41 | 8.37 |
| $H_{ci}$ (kOe) | 5.96 | 5.97 | 6.17 | 6.06 | 23.04 | 20.15 | 24.15 |
| $H_c$ (kOe) | 5.59 | 5.52 | 5.86 | 5.32 | 6.75 | 6.54 | 7.01 |
| $B_r$ (kG) | 12.09 | 12.09 | 11.44 | 11.84 | 7.98 | 7.64 | 7.85 |
| $(BH)_{max}$ (MGOe) | 26.76 | 26.47 | 25.26 | 23.22 | 15.75 | 15.42 | 15.55 |

Furthermore, sintered permanent magnets of the $Nd_2Fe_{14}B$ type were made in accordance with this invention (Samples W-1, W-2, W-3 and W-4) from powder crushed in water, the powder having the following base composition in weight percent Nd—35.4%, B—1.11% and Fe—balance. Sintered permanent magnets of the $SmCo_5$ type were also made in accordance with this invention (Samples W-5, W-6 and W-7) from powder crushed in water, the powder having the following base composition in weight percent: Sm—37% and Co—balance. For Samples W-1 through W-7, the powder utilized was wet compacted at a pressure of about 4 T/cm$^2$. Following compaction, the samples were placed in a vacuum furnace, the pressure was reduced to about $10^{-5}$ Torr, and the samples were then heated to approximately 200° C. for about 2 hours. The samples were then heated up from about 200° C. to 760° C. and, during this procedure, passivating gas was injected into the vacuum furnace chamber to passivate the compact samples when the temperature was from about 250° C. to 280° C. The passivating gas utilized for Samples W-1, W-3, and W-5 was $CO_2$. The passivating gas utilized for Samples W-4 and W-7 was $N_2$, and a combination of about 91% $CO_2$ and 9% $N_2$ was utilized for Samples W-2 and W-6. Thereafter, each compact sample was sintered and analyzed for magnetic properties. However, the sintered magnet samples were not heat treated, but the magnetic properties of the samples would be enhanced by heat treatment after sintering as can be appreciated by those skilled in the art. The results are reported in Table IV below and FIGS. 28–31.

TABLE IV

| SAMPLE NO. | W-1 | W-2 | W-3 | W-4 | W-5 | W-6 | W-7 |
|---|---|---|---|---|---|---|---|
| Crushing Time (min) | 10 | 10 | 15 | 10 | 20 | 30 | 30 |
| $P_a/P_b$ | 1:10 | 1:10 | 1:10 | 1:10 | 1:10 | 1:10 | 1:10 |
| Passivating Gas | $CO_2$ | $CO_2 + N_2$ | $CO_2$ | $N_2$ | $CO_2$ | $CO_2 + N_2$ | $N_2$ |
| $D_p$ (μm) | ~6 | ~6 | ~6 | ~6 | ~1.5 | ~1.5 | ~1.5 |
| Pressure (T/cm$^2$) | 4.0 | 4.0 | 4.0 | 5.0 | 4.0 | 4.0 | 5.0 |
| Density (g/cm$^3$) | 7.25 | 7.18 | 7.30 | 7.32 | 8.42 | 8.38 | 8.29 |
| $H_{ci}$ (kOe) | 4.88 | 5.88 | 7.33 | 7.15 | 19.50 | 18.50 | 19.20 |
| $H_c$ (kOe) | 4.63 | 5.50 | 6.76 | 6.43 | 6.50 | 6.80 | 6.64 |
| $B_r$ (kG) | 10.13 | 10.19 | 10.45 | 10.28 | 7.19 | 7.75 | 7.51 |

TABLE IV-continued

| SAMPLE NO. | W-1 | W-2 | W-3 | W-4 | W-5 | W-6 | W-7 |
|---|---|---|---|---|---|---|---|
| $(BH)_{max}$ (MGOe) | 20.24 | 21.96 | 22.68 | 21.94 | 15.64 | 15.98 | 15.04 |

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

What is claimed is:

1. A process for producing a rare earth-containing powder comprising crushing a rare earth-containing alloy in a passivating gas comprised of nitrogen, carbon dioxide or a combination of nitrogen and carbon dioxide at a temperature from ambient temperature to a temperature below the phase transformation temperature of the material, thereby producing a rare earth-containing powder which is resistant to oxidation.

2. The process of claim 1 wherein the passivating gas is carbon dioxide.

3. The process of claim 1 wherein the alloy comprises, in atomic percent of the overall composition, from about 12% to about 24% of at least one rare earth element selected from the group consisting of neodymium, praseodymium, lanthanum, cerium, terbium, dysprosium, holmium, erbium, europium, samarium, gadolinium, promethium, thulium, ytterbium, lutetium, yttrium, and scandium, from about 2% to about 28% boron and the balance iron.

4. The process of claim 1 wherein the alloy comprises $RM_5$ or $R_2M_{17}$, wherein R is at least one rare earth element selected from the group consisting of neodymium, praseodymium, lanthanum, cerium, terbium, dysprosium, holmium, erbium, europium, samarium, gadolinium, promethium, thulium, ytterbium, lutetium, yttrium, and scandium, and M is at least one metal selected from the group consisting of Co, Fe, Ni and Mn.

5. The process of claim 1 wherein the alloy is crushed to a particle size of from about 0.05 microns to about 100 microns.

6. The process of claim 5 wherein the alloy is crushed to a particle size of from 1 micron to 40 microns.

7. The process of claim 1 wherein the resultant powder has a surface concentration of nitrogen of from about 0.4 to about 26.8 atomic percent.

8. The process of claim 1 wherein the resultant powder has a surface concentration of carbon of from about 0.02 to about 15 atomic percent.

9. A process for producing a rare earth-containing powder comprising: crushing a rare earth-containing alloy in a passivating gas comprised of nitrogen, carbon dioxide or a combination of nitrogen and carbon dioxide for about 1 minute to about 60 minutes at a temperature from about 20° C. to about 580° C. to a particle size of from about 0.05 microns to about 100 microns, said alloy comprising, in atomic percent of the overall composition, from about 12% to about 24% of at least one rare earth element selected from the group consisting of neodymium, praseodymium, lanthanum, cerium, terbium, dysprosium, holmium, erbium, europium, samarium, gadolinium, promethium, thulium, ytterbium, lutetium, yttrium, and scandium, from about 2% to about 28% boron and the balance iron, thereby producing a rare earth-containing powder which is resistant to oxidation.

10. The process of claim 9 wherein the passivating gas is nitrogen.

11. The process of claim 9 wherein the rare earth-containing alloy is crushed to a particle size of from 1 micron to 40 microns.

12. The process of claim 9 wherein the resultant powder has a surface concentration of carbon of from about 0.02 to about 15 atomic percent.

13. The process of claim 12 wherein the resultant powder has a surface concentration of carbon of from 0.5 to 6.5 atomic percent.

14. A process for producing a permanent magnet comprising:

a) crushing a rare earth-containing alloy in a passivating gas comprised of nitrogen, carbon dioxide or a combination of nitrogen and carbon dioxide for about 1 minute to about 60 minutes at a temperature from about 20° C. to about 580° C. to a particle size of from about 0.05 microns to about 100 microns, said alloy comprising, in atomic percent of the overall composition, of from about 12% to about 24% of at least one rare earth element selected from the group consisting of neodymium, praseodymium, lanthanum, cerium, terbium, dysprosium, holmium, erbium, europium, samarium, gadolinium, promethium, thulium, ytterbium, lutetium, yttrium, and scandium, from about 2% to about 28% boron and the balance iron;

b) compacting the crushed alloy material;

c) sintering the compacted alloy material at a temperature from 900° C. to 1200° C. inclusive; and d) heat treating the sintered material at a temperature from 200° C. to 1050° C. inclusive, thereby producing a permanent magnet which is resistant to oxidation.

15. The process of claim 14 wherein the passivating gas is nitrogen.

16. The process of claim 14 wherein the rare earth-containing alloy is crushed to particle size of from 1 micron to 40 microns.

17. The process of claim 14 wherein the resultant permanent magnet has a surface concentration of nitrogen of from about 0.4 to about 26.8 atomic percent.

18. The process of claim 17 wherein the resultant permanent magnet has a surface concentration of nitrogen of 0.4 to 10.8 atomic percent.

19. The process of claim 14 wherein the resultant permanent magnet has a surface concentration of carbon of from about 0.02 to about 15 atomic percent.

20. The process of claim 19 wherein the resultant permanent magnet has a surface concentration of carbon of from 0.5 to 6.5 atomic percent.

21. A process for producing a rare earth-containing powder compact comprising crushing a rare earth-containing alloy in water, compacting the crushed alloy material, drying the compacted alloy material at a temperature below the phase transformation temperature of the material, and treating the compacted alloy material by passivating the material with a passivating gas comprised of nitrogen, carbon dioxide or a combination of nitrogen and carbon dioxide at a temperature from ambient temperature to a temperature below the phase transformation temperature of the material, thereby producing a rare earth-containing powder compact which is resistant to oxidation.

22. The process of claim 21 wherein the passivating gas is nitrogen.

23. The process of claim 21 wherein the alloy comprises, in atomic percent of the overall composition, from about 12% to about 24% of at least one rare earth element selected from the group consisting of neodymium, praseodymium, lanthanum, cerium, terbium, dysprosium, holmium, erbium, europium, samarium, gadolinium, promethium, thulium, ytterbium, lutetium, yttrium, and scandium, from about 2% to about 28% boron and the balance iron.

24. The process of claim 23 wherein the alloy comprises $RM_5$ or $R_2M_{17}$, wherein R is at least one rare earth element selected from the group consisting of neodymium, praseodymium, lanthanum, cerium, terbium, dysprosium, holmium, erbium, europium, samarium, gadolinium, promethium, thulium, ytterbium, lutetium, yttrium, and scandium, and M is at least one metal selected from the group consisting of Co, Fe, Ni and Mn.

25. The process of claim 23 wherein the alloy is crushed in water to a particle size of from about 0.05 microns to about 100 microns.

26. The process of claim 25 wherein the alloy is crushed in water to a particle size of from 1 micron to 40 microns.

27. The process of claim 21 wherein the compacted alloy material is vacuum dried or dried with an inert gas.

28. The process of claim 27 wherein the inert gas is selected from the group consisting of argon and helium.

29. The process of claim 21 wherein the resultant powder compact has a surface concentration of nitrogen of from about 0.4 to about 26.8 atomic percent.

30. The process of claim 21 wherein the resultant powder compact has a surface concentration of carbon of from about 0.02 to about 15 atomic percent.

31. A process for producing a rare earth-containing powder compact comprising: crushing a rare earth-containing alloy in water to a particle size of from about 0.05 microns to about 100 microns, said alloy comprising, in atomic percent of the overall composition, from about 12% to about 24% of at least one rare earth element selected from the group consisting of neodymium, praseodymium, lanthanum, cerium, terbium, dysprosium, holmium, erbium, europium, samarium, gadolinium, promethium, thulium, ytterbium, lutetium, yttrium, and scandium, from about 2% to about 28% boron and the balance iron; compacting the wet crushed alloy material to form wet compacted material; drying the compacted alloy material at a temperature below the phase transformation temperature of the material; and treating the compacted alloy material by passivating the material with a passivating gas comprised of nitrogen, carbon dioxide or a combination of nitrogen and carbon dioxide for about 1 minute to about 60 minutes at a temperature from about 20° C. to about 580° C., thereby producing a rare earth-containing powder compact which is resistant to oxidation.

32. The process of claim 31 wherein the passivating gas is nitrogen.

33. The process of claim 31 wherein the rare earth-containing alloy is crushed in water to a particle size of from 1 micron to 40 microns.

34. The process of claim 31 wherein the compacted alloy material is vacuum dried or dried with an inert gas.

35. The process of claim 31 wherein the resultant powder compact has a surface concentration of nitrogen of from about 0.4 to about 26.8 atomic percent.

36. The process of claim 35 wherein the resultant powder compact has a surface concentration of nitrogen of 0.4 to 10.8 atomic percent.

37. The process of claim 31 wherein the resultant powder compact has a surface concentration of carbon of from about 0.02 to about 15 atomic percent.

38. The process of claim 37 wherein the resultant powder compact has a surface concentration of carbon of from 0.5 to 6.5 atomic percent.

39. A process for producing a permanent magnet comprising:

a) crushing a rare earth-containing alloy in water to a particle size of from about 0.05 microns to about 100 microns, said alloy comprising, in atomic percent of the overall composition, of from about 12% to about 24% of at least one rare earth element selected from the group consisting of neodymium, praseodymium, lanthanum, cerium, terbium, dysprosium, holmium, erbium, europium, samarium, gadolinium, promethium, thulium, ytterbium, lutetium, yttrium, and scandium, from about 2% to about 28% boron and the balance iron;

b) compacting the crushed alloy material;

c) drying the compacted alloy material at a temperature below the phase transformation temperature of the material;

d) treating the compacted alloy material by passivating the material with a passivating gas comprised of nitrogen, carbon dioxide or a combination of nitrogen and carbon dioxide for about 1 minute to about 60 minutes at a temperature from about 20° C. to about 580° C.;

e) sintering the compacted alloy material at a temperature from 900° C. to 1200° C. inclusive; and d) heat treating the sintered material at a temperature from 200° C. to 1050° C. inclusive, thereby producing a permanent magnet which is resistant to oxidation.

40. The process of claim 39 wherein the passivating gas is nitrogen.

41. The process of claim 39 wherein the rare earth-containing alloy is crushed in water to particle size of from 1 micron to 40 microns.

42. The process of claim 39 wherein the compacted alloy material is vacuum dried or dried with an inert gas.

43. The process of claim 39 wherein the resultant permanent magnet has a surface concentration of nitrogen of from about 0.4 to about 26.8. atomic percent.

44. The process of claim 43 wherein the resultant permanent magnet has a surface concentration of nitrogen of 0.4 to 10.8 atomic percent.

45. The process of claim 39 wherein the resultant permanent magnet has a surface concentration of carbon of from about 0.02 to about 15 atomic percent.

46. The process of claim 45 wherein the resultant permanent magnet has a surface concentration of carbon of from 0.5 to 6.5 atomic percent.

* * * * *